US008601758B2

(12) United States Patent
Biadora

(10) Patent No.: US 8,601,758 B2
(45) Date of Patent: Dec. 10, 2013

(54) INTERLOCKING CONSTRUCTION BLOCKS

(75) Inventor: Salvador M. Biadora, Santa Fe, NM (US)

(73) Assignee: Samobi Industries, LLC, Santa Fe, NM (US)

( * ) Notice: Subject to any disclaimer, the term of this patent is extended or adjusted under 35 U.S.C. 154(b) by 0 days.

(21) Appl. No.: 13/293,674

(22) Filed: Nov. 10, 2011

(65) Prior Publication Data

US 2013/0061549 A1 Mar. 14, 2013

Related U.S. Application Data

(60) Provisional application No. 61/532,546, filed on Sep. 8, 2011.

(51) Int. Cl.
*E04C 5/08* (2006.01)

(52) U.S. Cl.
USPC ..... 52/223.7; 52/574; 52/589.1; 52/604; 52/609

(58) Field of Classification Search
USPC ..... 52/302.4, 574, 604, 608, 609, 223.7, 52/589.1
See application file for complete search history.

(56) References Cited

U.S. PATENT DOCUMENTS

| | | | | | |
|---|---|---|---|---|---|
| 127,628 | A | * | 6/1872 | Merlette | 404/34 |
| 468,838 | A | * | 2/1892 | Steiger | 52/284 |
| 1,306,246 | A | * | 6/1919 | Bried | 52/603 |
| 2,241,169 | A | * | 5/1941 | Yokes | 52/223.7 |
| 2,374,624 | A | * | 4/1945 | Schwendt | 52/223.5 |
| 2,811,035 | A | * | 10/1957 | Zagray | 52/436 |
| 4,148,166 | A | * | 4/1979 | Toone | 52/309.12 |
| 4,152,875 | A | * | 5/1979 | Soland | 52/223.7 |
| 4,433,521 | A | * | 2/1984 | Dietrich | 52/302.4 |
| 4,593,513 | A | * | 6/1986 | Stratton | 52/578 |
| 4,711,057 | A | * | 12/1987 | Lew et al. | 52/81.2 |
| 4,891,925 | A | * | 1/1990 | Carlson et al. | 52/585.1 |
| 4,993,206 | A | * | 2/1991 | Pardo | 405/286 |
| 5,051,023 | A | * | 9/1991 | Yoshida et al. | 404/39 |
| 5,129,347 | A | * | 7/1992 | Hill | 114/266 |

(Continued)

FOREIGN PATENT DOCUMENTS

EP 0093417 11/1983

OTHER PUBLICATIONS

International Search Report & Written Opinion of PCT Application No. PCT/US11/60247, mailed Sep. 27, 2012, 9 pgs.

*Primary Examiner* — Basil Katcheves
*Assistant Examiner* — Joshua Ihezie
(74) *Attorney, Agent, or Firm* — Loza & Loza, LLP; Heidi L. Eisenhut

(57) ABSTRACT

Interlocking construction blocks are provided, having a tongue and groove configuration, attachable together by pressing the tongue of one block into a groove of another block. Multiple blocks may be adapted to be interlocked together forming a structure, such as a wall. Blocks comprise first and second opposing sidewalls integrally connected together by first and second pairs of opposing connecting walls. The first and second sidewalls comprise a lower portion integrally connected to an upper portion. The lower portion comprises a pair of opposing lower portion sidewalls integrally connected to a pair of opposing lower end walls. The upper portion comprises a planar top surface, a pair of opposing upper portion sidewalls and a pair of opposing upper portion end walls integrally connected via upper portion angular walls. The upper portion sidewalls, upper portion end walls and upper angular walls may have a beveled or tapered surface.

9 Claims, 23 Drawing Sheets

(56) References Cited

U.S. PATENT DOCUMENTS

| | | | | | |
|---|---|---|---|---|---|
| 5,224,792 | A | * | 7/1993 | Hagenah | 404/39 |
| D346,667 | S | * | 5/1994 | Blomquist et al. | D25/113 |
| D352,789 | S | * | 11/1994 | Adam | D25/113 |
| 5,367,846 | A | * | 11/1994 | vonRoenn, Jr. | 52/308 |
| 5,377,468 | A | * | 1/1995 | Repasky | 52/302.4 |
| 5,490,362 | A | * | 2/1996 | Mercier | 52/582.1 |
| 5,588,271 | A | * | 12/1996 | Pitchford | 52/306 |
| 5,618,602 | A | | 4/1997 | Nelson | |
| 5,622,456 | A | * | 4/1997 | Risi et al. | 405/284 |
| 5,904,019 | A | * | 5/1999 | Kooij et al. | 52/306 |
| 5,921,710 | A | * | 7/1999 | Scales | 405/20 |
| 5,987,829 | A | * | 11/1999 | Fisher | 52/306 |
| 6,138,426 | A | * | 10/2000 | Mork et al. | 52/562 |
| 6,508,042 | B1 | * | 1/2003 | Kweon et al. | 52/608 |
| 6,579,038 | B1 | * | 6/2003 | McAllister et al. | 405/16 |
| 6,606,835 | B1 | * | 8/2003 | Bilka | 52/604 |
| 6,763,644 | B1 | * | 7/2004 | Toledo | 52/592.6 |
| 6,920,724 | B1 | * | 7/2005 | Hundley | 52/167.3 |
| 6,939,077 | B1 | * | 9/2005 | Hart | 404/39 |
| 6,941,718 | B1 | * | 9/2005 | diGirolamo et al. | 52/695 |
| 6,988,341 | B2 | * | 1/2006 | Regina | 52/306 |
| 7,108,577 | B2 | | 9/2006 | Peters et al. | |
| 7,254,924 | B2 | * | 8/2007 | Regina | 52/306 |
| 7,299,596 | B2 | * | 11/2007 | Hildreth | 52/695 |
| 7,367,167 | B2 | * | 5/2008 | Takayanagi | 52/604 |
| 7,458,186 | B2 | * | 12/2008 | Carter | 52/81.1 |
| 8,091,303 | B2 | * | 1/2012 | Losonczi | 52/307 |
| 8,201,370 | B1 | * | 6/2012 | Goodwin | 52/285.2 |
| 2005/0257480 | A1 | * | 11/2005 | Toledo | 52/604 |
| 2006/0123732 | A1 | * | 6/2006 | Takayanagi | 52/604 |
| 2008/0134605 | A1 | * | 6/2008 | Friesen et al. | 52/308 |
| 2008/0184649 | A1 | | 8/2008 | Khan | |
| 2008/0202054 | A1 | * | 8/2008 | Abella | 52/568 |
| 2010/0223876 | A1 | * | 9/2010 | Jones | 52/588.1 |

* cited by examiner

INTERLOCKING CONSTRUCTION BLOCKS

CLAIM OF PRIORITY UNDER 35 U.S.C. §119

The present Application for Patent claims priority to Provisional Application No. 61/532,546 entitled "Interlocking Construction Blocks" filed Sep. 8, 2011 and is hereby expressly incorporated by reference herein.

FIELD

Various features relate to improvements to interlocking construction blocks.

BACKGROUND

Generally, conventional concrete pavement blocks are used in building structures such as walls and partitions. Building the structure typically requires reinforcing rods or steel rebar that projects upwardly from the foundation footing or slab on which the structure is being built, cement, tie wires and skilled labor that would laboriously have to prepare the aggregates, grouting, plastering and finishing including preparation and installation of steel bars, horizontal reinforcement, and electrical switches. As all this takes time to complete, the cost of the project also increases.

Consequently, what is needed is an interlocking construction block that minimizes construction labor time, is easy to install for both internal and external walls and pavement and has less material wastage compared to the conventional and time consuming methods and procedures of cast-in-place concrete pouring for ground slab and installation of concrete hollow blocks.

SUMMARY

In one aspect, an interconnecting construction block is provided. The block comprises a first sidewall comprising a first lower portion; and a first upper portion integrally connected to the first lower portion. The first upper portion comprises a first plurality of walls; and a first outer side surface integrally connected to the first plurality of walls, the first plurality of walls tapering inwardly from the first lower portion to the first outer side surface; a second sidewall integrally connected to the first sidewall by at least one upper end wall and at least one side end wall, where the at least one upper end wall and the at least one side end wall have a tongue and groove configuration.

The plurality of walls comprise a pair of upper portion sidewalls; and a pair of upper portion end walls integrally connected to the plurality of upper portion sidewalls by upper portion angular walls forming an octagonal configuration. The second sidewall comprises a second lower portion integrally connected to a second upper portion, the second upper portion comprising a second plurality of walls; and a second outer side surface integrally connected to the second plurality of walls, the second plurality of walls tapering inwardly from the second lower portion to the second outer side surface.

In another aspect, the block comprises a pair of reinforcement bars embedded within the first and second sidewalls. The pair of reinforcement bars comprises a first reinforcement bar having a first end and a second end extending from a first corner of the block to a first catty corner; and a second reinforcement bar having a third end and a fourth end extending from a second corner of the block to a second catty corner. At least one of the first, second, third and fourth ends has a generally "Y" configuration having a first Y-end and a second Y-end; wherein the first Y-end extends to a first corner of the first sidewall and the second Y-end extends to a first corner of the second sidewall; and wherein the first and second Y-ends protrude through the first and second sidewalls. The protruding first and second Y-ends may be welded to an adjoining reinforcement bar of another matingly engaged block.

In another aspect, a first threaded member extends from and protruding through a first corner of the first sidewall to a second corner of the first sidewall; a second threaded member extends from and protruding through a second corner of the first sidewall to a second corner of the first sidewall; a third threaded member extends from and protruding through a third corner of the first sidewall to a third corner of the first sidewall; and a fourth threaded member extends from and protruding through a fourth corner of the first sidewall to a fourth corner of the first sidewall; wherein the first reinforcement bar is integrally connected to and extends between the first threaded member and the third threaded member; and wherein the second reinforcement bar is integrally connected to and extends between the second threaded member and the fourth threaded member.

In another aspect, a first corner plate is integrally connected to the first threaded member; and an outer plate is integrally connected to the first corner plate and adjoining corner plates of adjoining matingly engaged blocks. The outer plate is bolted or welded to the first corner plate and adjoining corner plates. In another aspect, a conduit is embedded within the block for protecting and routing electrical wires and cables; and a box is embedded within the block and integrally connected to an end of the conduit, the box for inserting an electrical outlet. In another aspect, an insulating material pre-fabricated within a center portion of the block.

In another aspect, the block further includes a base sidewall section integrally connected to the first and second sidewalls. The base sidewall section comprises a front surface; and a back surface integrally connected to the front surface by a pair of opposing connecting sidewalls and a pair of opposing connecting end walls; and wherein the first and second sidewalls are located equidistant from the pair of opposing connecting end walls and extend perpendicularly from the base sidewall section.

In another aspect, an interconnecting construction block is provided. The block comprises a first sidewall. The first sidewall comprises a first lower portion; and a first upper portion integrally connected to the first lower portion. The first upper portion comprises a first plurality of walls; and a first outer side surface integrally connected to the first plurality of walls, the first plurality of walls tapering inwardly from the first lower portion to the first outer side surface; a second sidewall integrally connected to the first sidewall by at least one upper end wall and at least one side end wall, where the at least one upper end wall and the at least one side end wall have a tongue and groove configuration, the second sidewall comprises a second lower portion; and a second upper portion integrally connected to the second lower portion, the second upper portion comprising: a second plurality of walls; and a second outer side surface integrally connected to the second plurality of walls, the second plurality of walls tapering inwardly from the second lower portion to the second outer side surface.

In another aspect, the plurality of walls comprise a pair of upper portion sidewalls; and a pair of upper portion end walls integrally connected to the plurality of upper portion sidewalls by upper portion angular walls forming an octagonal configuration.

In another aspect, a pair of reinforcement bars is embedded within the first and second sidewalls. The pair of reinforcement bars comprises a first reinforcement bar having a first end and a second end extending from a first corner of the block to a first catty corner; and a second reinforcement bar having a third end and a fourth end extending from a second corner of the block to a second catty corner.

In another aspect, at least one of the first, second, third and fourth ends has a generally "Y" configuration having a first Y-end and a second Y-end; wherein the first Y-end extends to a first corner of the first sidewall and the second Y-end extends to a first corner of the second sidewall.

In another aspect, a first threaded member is integrally connected to and extending upwardly from the first Y-end, the first threaded member protruding through the first sidewall; and a second threaded member integrally connected to and extending upwardly from the second Y-end, the second threaded member protruding through the second sidewall.

In another aspect, a first corner plate integrally connected to the first threaded member; and wherein an outer plate is integrally connected to the first corner plate and adjoining corner plates of adjoining matingly engaged blocks.

BRIEF DESCRIPTION OF THE DRAWINGS

The features, nature, and advantages of the present aspects may become more apparent from the detailed description set forth below when taken in conjunction with the drawings in which like reference characters identify correspondingly throughout.

DETAILED DESCRIPTION OF THE INVENTION

Figure 1B:
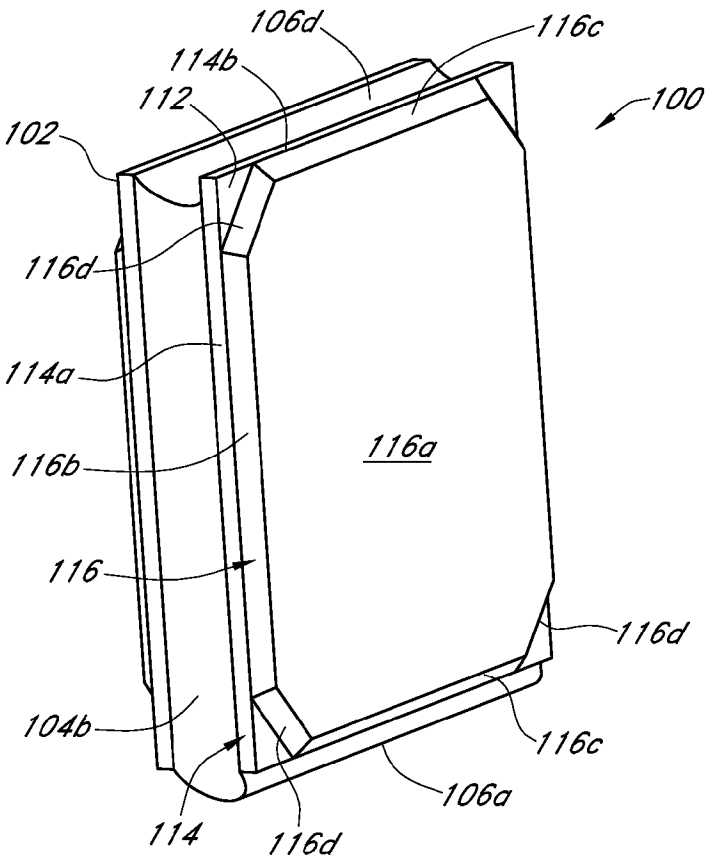
FIG. 1 (comprising FIGS. 1A and 1B) illustrates side perspective views of an interlocking construction block, according to one aspect.

In the following detailed description, numerous specific details are set forth in order to provide a thorough understanding of the embodiments. However, it will be understood by one of ordinary skill in the art that the embodiments may be practiced without these specific details. For example, well-known operations, structures and techniques may not be shown in detail in order not to obscure the embodiments.

In the following description, certain terminology is used to describe certain features of one or more embodiments. The term "construction block" may refer to any type of masonry block common in the building of structures. The term "structure" may refer to any type of a body or assemblage of bodies formed from construction blocks including, but not limited to, interior walls, exterior walls, fences, foundations, partitions, roofs, ceilings, floors and countertops. The construction blocks may be made from any material known in the art, including but not limited to, brick, stone, marble, granite, travertine, limestone, concrete and glass. The term "grout" or "mortar" may refer to any type of construction material used to seal joints, such as the spaces found between blocks, to embed rebar in masonry walls, and to connect sections of pre-cast concrete.

According to one aspect, interlocking construction blocks are provided. The interlocking construction blocks, as described in detail below, may include factory waterproofing for external walls, a welded interlocking system for block stabilization, self-embedded deformed steel bars for structural reinforcement, ready to paint surface for plain and rough faces, and built-in electrical conduit pipes and utility boxes for electrical outlets and switches. The interlocking construction blocks may be constructed with a variety of selected wall finishes including but not limited to plain cement finished, anay finished and brick finished. The interlocking construction blocks minimize construction time for labor and provide easy installation both for internal and external walls as well as pavement with less material wastage compared to the conventional and time consuming methods and procedures of cast-in-place concrete pouring for ground slab and installation of concrete hollow blocks. Furthermore, the interlocking construction blocks of the present invention may minimize the cost of construction materials, the cost of labor and eliminate the messy process of mixing concrete and chipping of concrete for electrical outlets and switches. As less time, effort and resources will be needed for the construction of structures, buildings and residential houses can become more affordable.

According to one aspect, the interlocking construction blocks may be of varying shape, size and thickness depending on the requirement of design of the tongue and groove for continuous interlocking features. As discussed in detail below, the interlocking construction blocks may be embedded with reinforcement bars. The reinforcement bars may be deformed, round or square bars and may be used as bracings that may be spot welded so each block can have a permanent stabilized interlocking system.

According to one aspect, the interlocking construction blocks may be column and footing connector blocks. The column and footing connector blocks may have extended reinforcement bars that extend out of the block so as to be connected to columns and footers in the construction of a structure. The reinforcement bars may extend out one or more sides of the block. According to one aspect, the interlocking construction blocks may have various combinations of planar and tongue and groove sides to form any type of block needed, such as a corner end block, a corner block connecter, etc. According to one aspect, the interlocking construction blocks may have one or more planar sides while the other sides may be tongue and groove so that the block may be used as an end block.

Figure 1A:
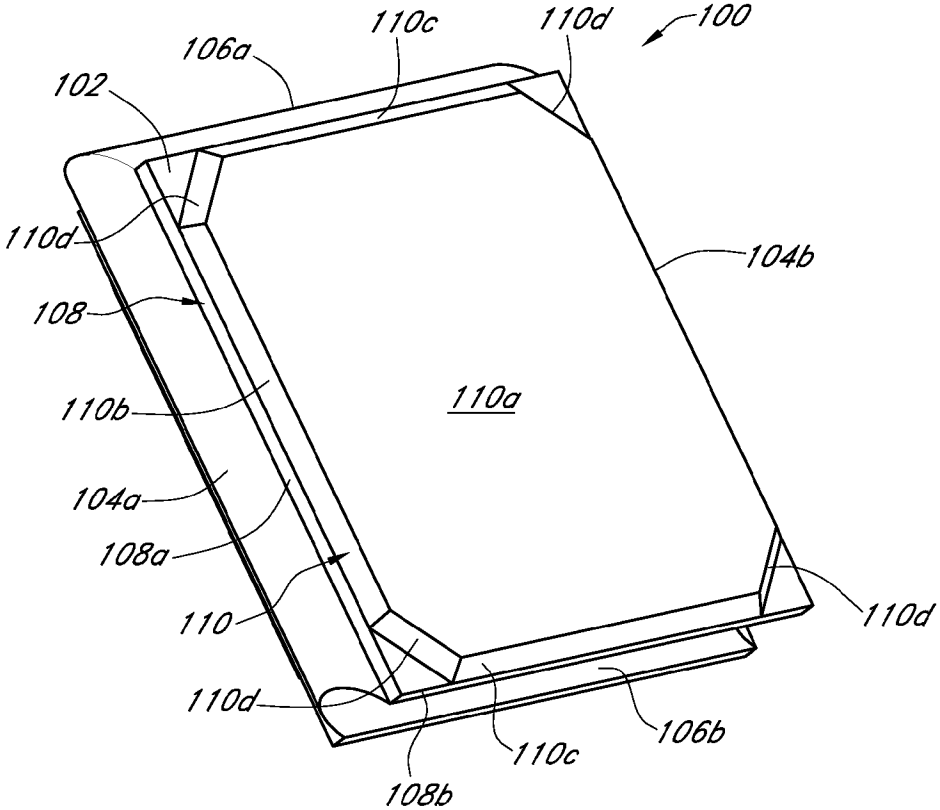
Figure 3:
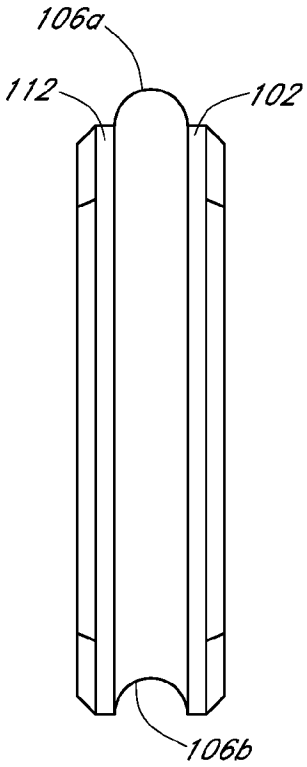
FIG. 3 illustrates a side plan view of the interlocking construction block of FIG. 1.
Figure 2:
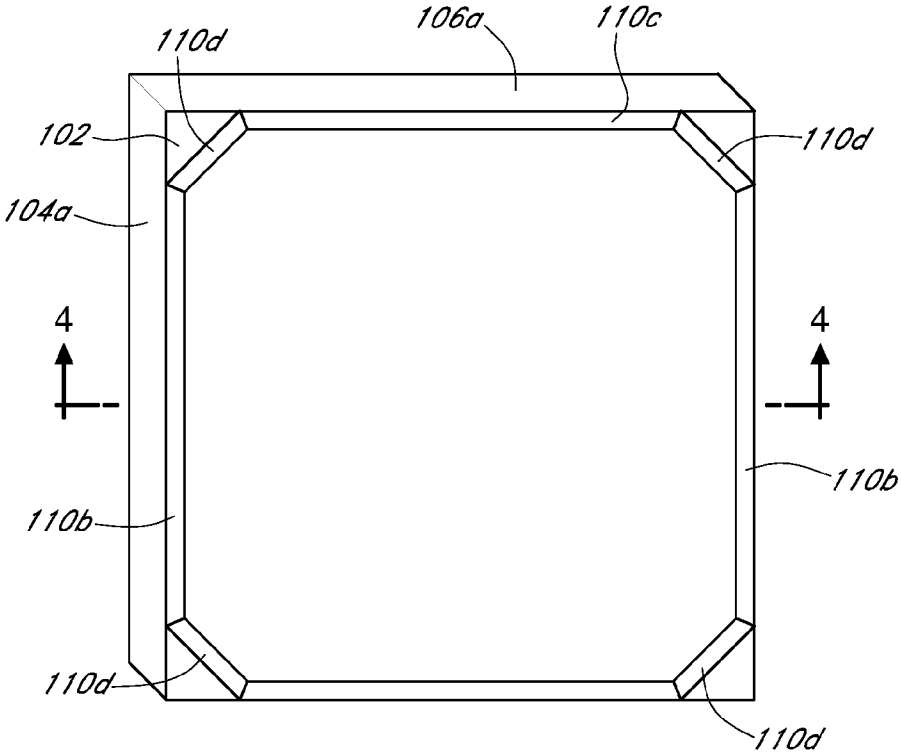
FIG. 2 illustrates a top plan view of the interlocking construction block of FIG. 1.
Figure 4:
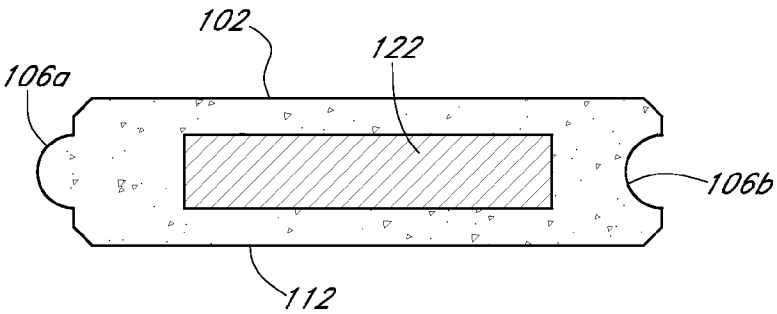
FIG. 4 illustrates a cross-sectional view of the interlocking construction block taken along line 4-4 of FIG. 2.
Figure 5:
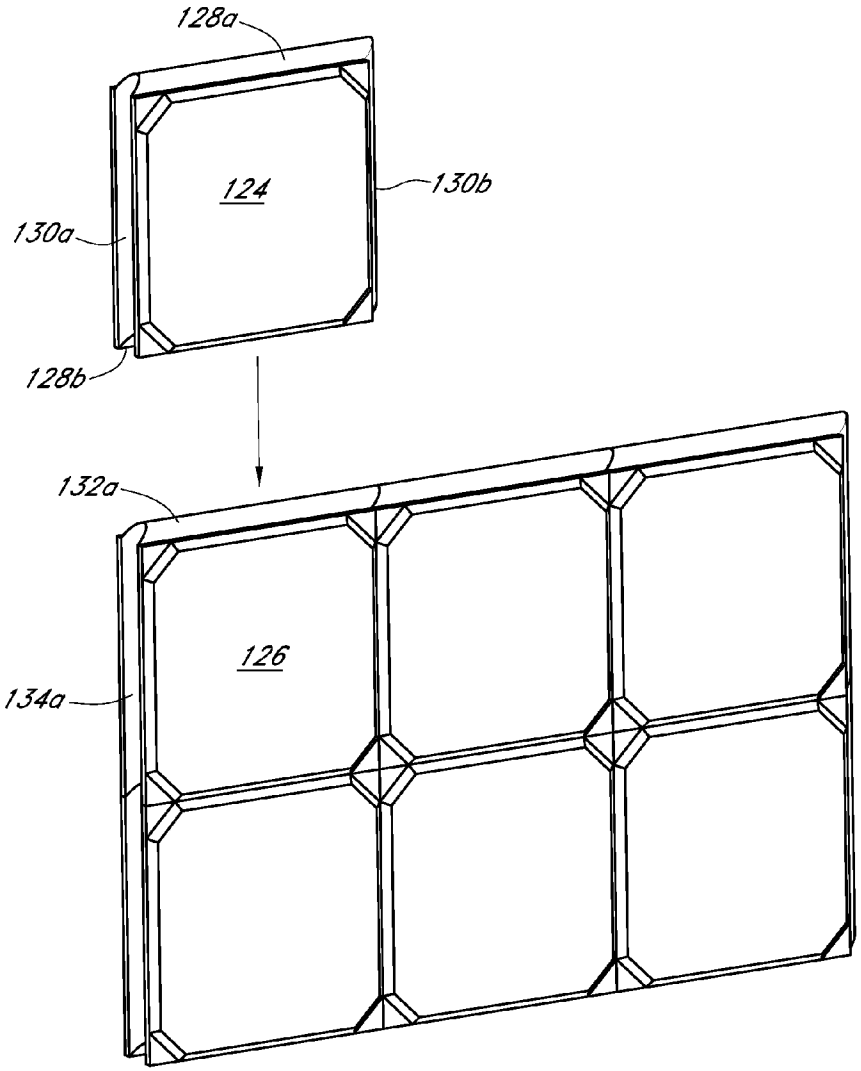
FIG. 5 illustrates multiple interlocking construction blocks interconnected.

FIG. 1 (comprising FIGS. 1A and 1B) illustrates side perspective views of an interlocking construction block according to one aspect. FIG. 2 illustrates a top plan view of the interlocking construction block of FIG. 1. FIG. 3 illustrates a side plan view of the interlocking construction block of FIG. 1. FIG. 4 illustrates a cross-sectional view of the interlocking construction block taken along line 4-4 of FIG. 2. FIG. 5 illustrates multiple interlocking construction blocks interconnected. The following discussion refers interchangeably to FIGS. 1-5.

The interlocking construction blocks (hereinafter referred to as "blocks" or "block") may be tongue and groove blocks that are attachable together by pressing the tongue of one block into a groove of another block. Multiple blocks may be adapted to be interlocked together forming a structure, such as a wall. (See FIG. 5) A block 100 may comprise first and second opposing sidewalls 102, 112 integrally connected together by a first pair of opposing connecting walls 104*a*, 104*b* and a second pair of opposing connecting walls 106*a*, 106*b*. According to one example, the first pair of opposing connecting walls 104*a*, 104*b* and the second pair of opposing connecting walls 106*a*, 106*b* may be formed of a flat planar wall, a grooved longitudinal wall or a tongued longitudinal wall. Tongued longitudinal walls are adapted to interconnect with grooved longitudinal walls of identical or substantially similar blocks. Although the tongues and grooves of the walls are shown having convex and concave surfaces, respectively, this is by way of example only and other shapes such as square or rectangular may be used. Additionally, although the tongue and grooves are shown extending the entire length of the wall, this is by way of example only.

According to one aspect, the first and second sidewalls 102 and 112 may be generally square in shape, however, in alternative aspects, the sidewalls may be other shapes such as triangles, rectangle or other polygons.

The first sidewall 102 may comprise a lower portion 108 integrally connected to an upper portion 110. The lower portion 108 may comprise a pair of opposing lower portion sidewalls 108*a* integrally connected to a pair of opposing lower end walls 108*b*. The upper portion 110 may comprise a top surface 110*a*, a pair of opposing upper portion sidewalls 110*b* and a pair of opposing upper portion end walls 110*c* integrally connected via upper portion angular walls 110*d* forming an octagonal configuration. The upper portion sidewalls 110*b*, upper portion end walls 110*c* and upper angular walls 110*d* may have a beveled or tapered surface. The beveling or tapering of the upper portion sidewalls 110*b*, upper portion end walls 110*c* and upper portion angular walls 110*d* provide a space for grout or mortar to be applied between interlocking construction blocks for securing the interlocking construction blocks together as well as providing additional strength to the structure and tightening of the joints of the blocks. Additionally, beveling or tapering the upper portion sidewalls 110*b*, upper portion end walls 110*c* and upper portion angular walls 110*d* may reduce the cracking of joints compared to just a straight edge where there is no space for grout. Having straight edges also makes patching the joints difficult and they are prone to cracks. Although the top surface 110*a* is shown as planar, this is by way of example only.

The second sidewall 112 may comprise a lower portion 114 integrally connected to an upper portion 116. The lower portion 114 may comprise a pair of opposing lower portion sidewalls 114*a* integrally connected to a pair of opposing lower end walls 114*b*. The upper portion 116 may comprise a top surface 116*a*, a pair of opposing upper portion sidewalls 116*b* and a pair of opposing upper portion end walls 116*c* integrally connected via upper portion angular walls 110*d* forming an octagonal configuration. The upper portion sidewalls 116*b*, upper portion end walls 116*c* and upper angular walls 116*d* may have a beveled or tapered surface which provides a space for grout or mortar to be applied for securing the interconnected blocks together as well as providing additional strength to the structure and tightening of the joints of the blocks. Additionally, beveling or tapering the upper portion sidewalls 116*b*, upper portion end walls 116*c* and upper portion angular walls 116*d* reduce the cracking of joints compared to just a straight edge where there is no space for grout. Having straight edges also makes patching the joints difficult and they are prone to cracks. Although the top surface 116*a* is shown as planar, this is by way of example only.

FIG. 4 illustrates a cross-sectional view of the interlocking construction block 100 taken along line 4-4 of FIG. 2. As shown, an interior portion 122 of the block 100 may be comprised of a different type of material. For example, an insulated material, such as a foam board, may be located in the interior portion 122 of the interlocking construction block 100. Blocks having insulated material may be used, for example, in the construction of exterior walls in cold climates to keep out the cold from the interiors of structures. The insulated material may also be used as a moisture barrier to keep moisture from entering the interior of a structure and causing mold.

By utilizing blocks having an interior portion pre-fabricated with an insulating material, structures, such as walls, can be built and completed faster than typical structures as the insulation is already installed. Conventionally, walls are erected using blocks without an insulating material resulting in the insulating material having to be added after erecting the structure but before plaster/stucco or finishing walls can be added completing the structure. These additional steps add not only time but cost to completing the structure.

According to one example, as shown in FIG. 5, the interlocking construction blocks may be used to form a wall. In forming the wall, a first block 124 may be interconnected with a second block 126. The first block 124 may include a first pair of opposing connecting walls having a tongued longitudinal wall 128*a* and a grooved longitudinal wall 128*b* and a second pair of opposing connecting walls having a tongued longitudinal wall 130*a* and a grooved longitudinal wall 130*b*. The second block 126 may include a first pair of opposing connecting walls having a tongued longitudinal wall 132*a* and a grooved longitudinal wall 132*b* (not shown) and a second pair of opposing connecting walls having a tongued longitudinal wall 134*a* and a grooved longitudinal wall 134*b* (not shown).

The tongued longitudinal wall 132*a* of the second block 126 is adapted to interconnect with the grooved longitudinal wall 128*b* of the first block 124. This process is repeated with additional blocks to form the structure. As described above, grout may be applied to the beveling in the upper portion of the sidewalls for securing the interlocking construction blocks together as well as providing additional strength to the structure and tightening of the joints of the blocks.

Figure 6:
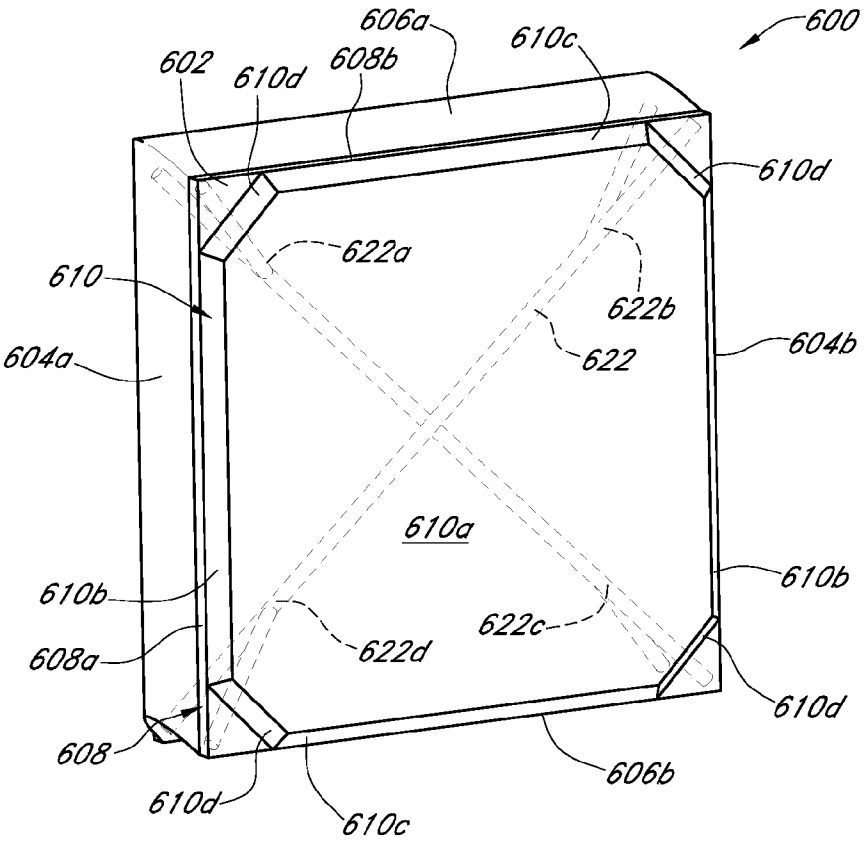
FIG. 6 illustrates a side perspective view of an interlocking construction block, according to one aspect.

FIG. 6 illustrates a side perspective view of an interlocking construction block 600 according to one aspect. The block 600 may comprise first and second opposing sidewalls 602, 612 (not shown) integrally connected together by a first pair of opposing connecting walls 604*a*, 604*b* and a second pair of opposing connecting walls 606*a*, 606*b*. According to one example, the first pair of opposing connecting walls 604*a*, 604*b* and the second pair of opposing connecting walls 606*a*, 606*b* may be formed of a flat planar wall, a grooved longitudinal wall or a tongued longitudinal wall. Tongued longitudinal walls are adapted to interconnect with grooved longitudinal walls of identical or substantially similar blocks. Although the tongues and grooves of the walls are shown having convex and concave surfaces, respectively, this is by way of example only and other shapes such as square or rectangular may be used. Additionally, although the tongue and grooves are shown extending the entire length of the wall, this is by way of example only.

The first sidewall 602 may comprise a lower portion 608 integrally connected to an upper portion 610. The lower portion 608 may comprise a pair of opposing lower portion sidewalls 608*a* integrally connected to a pair of opposing lower end walls 608*b*. The upper portion 610 may comprise a top surface 610*a*, a pair of opposing upper portion sidewalls 610*b* and a pair of opposing upper portion end walls 610*c* integrally connected via upper portion angular walls 610*d* forming an octagonal configuration. The upper portion sidewalls 610*b*, upper portion end walls 610*c* and upper angular walls 610*d* may have a beveled or tapered surface. Although the top surface 610*a* is shown as planar, this is by way of example only.

According to one embodiment, a pair of reinforcement bars 622 may be embedded within the block 600. As shown, each of the reinforcement bars 622 may be arranged diagonally in a "X" pattern extending from one corner to the catty-corner. Each of the reinforcement bars 622 may extend the entire diagonal length or a partial diagonal length. The ends 622*a*-622*d* of each of the reinforcement bars 622 may have a generally "Y" configuration. That is, each of the four (4) ends of the reinforcement bars 622 may split off forming a "Y". A first leg of the "Y" end may extend to a first corner on the first sidewall 602 and a second leg of the "Y" may extend to a first corner on the second sidewall 612, opposite the first corner. The first and second legs of the "Y" end may protrude through corners of the sidewalls 602 and 612 allowing the block 600, via the reinforcement bars 622, to be bolted or welded to corners plates, as discussed below in more detail.

Figure 7:
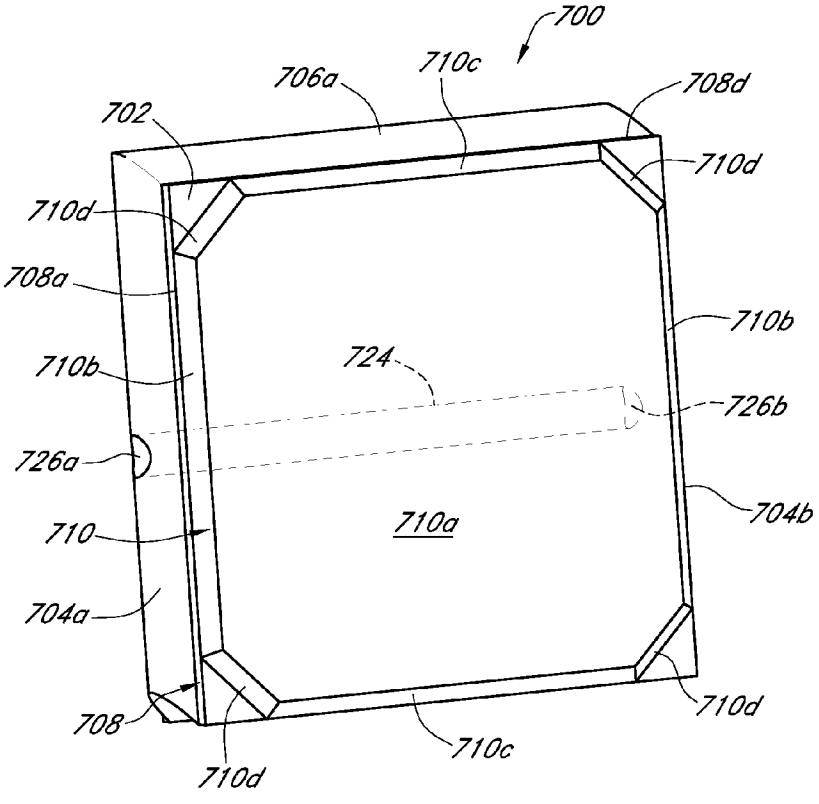
FIG. 7 illustrates a side perspective view of an interlocking construction block, according to one aspect.

FIG. 7 illustrates a side perspective view of an interlocking construction block 700 according to one aspect. The block 700 may comprise first and second opposing sidewalls 702, 712 (not shown) integrally connected together by a first pair of opposing connecting walls 704*a*, 704*b* and a second pair of opposing connecting walls 706*a*, 706*b*. According to one example, the first pair of opposing connecting walls 704*a*, 704*b* and the second pair of opposing connecting walls 706*a*, 706*b* may be formed of a flat planar wall, a grooved longitudinal wall or a tongued longitudinal wall. Tongued longitudinal walls are adapted to interconnect with grooved longitudinal walls of identical or substantially similar blocks. Although the tongues and grooves of the walls are shown having convex and concave surfaces, respectively, this is by way of example only and other shapes such as square or rectangular may be used. Additionally, although the tongue and grooves are shown extending the entire length of the wall, this is by way of example only.

The first sidewall 702 may comprise a lower portion 708 integrally connected to an upper portion 710. The lower portion 708 may comprise a pair of opposing lower portion sidewalls 708*a* integrally connected to a pair of opposing lower end walls 708*b*. The upper portion 710 may comprise a top surface 710*a*, a pair of opposing upper portion sidewalls 710*b* and a pair of opposing upper portion end walls 710*c* integrally connected via upper portion angular walls 710*d* forming an octagonal configuration. The upper portion sidewalls 710*b*, upper portion end walls 710*c* and upper angular walls 710*d* may have a beveled or tapered surface. Although the top surface 710*a* is shown as planar, this is by way of example only.

According to one embodiment, the block 700 may include a conduit 724 embedded within the block 700. The conduit 724 may be used for protecting and routing electrical wires and cables, for example, and may include a first opening 726*a* and a second opening 726*b* for insertion of the wires or cables. The conduit 724 may be made of any material known in the art, including but not limited to, metal, plastic, fiber, or fired clay. The conduit 724 may extend partially or completely through the block 700. Although the conduit 724 is shown extending horizontally through the block 700, this is by way of example only. The conduit 724 may extend vertically, diagonally or any combination thereof. Furthermore, although the conduit 724 is shown as straight, the conduit may also be curved or any combination thereof.

Figure 8:
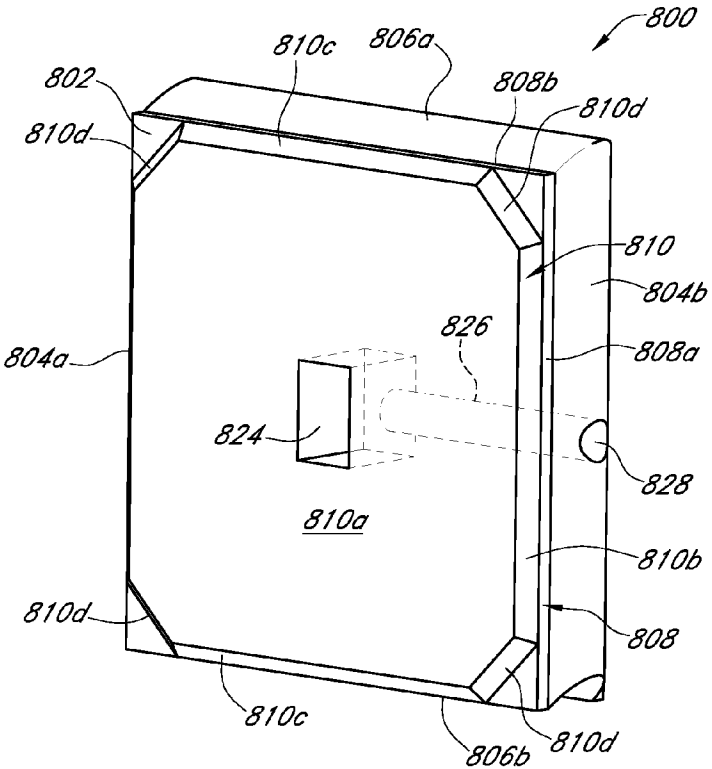
FIG. 8 illustrates a side perspective view of an interlocking construction block, according to one aspect.

FIG. 8 illustrates a side perspective view of an interlocking construction block 800 according to one aspect. The block 800 may comprise first and second opposing sidewalls 802, 812 (not shown) integrally connected together by a first pair of opposing connecting walls 804*a*, 804*b* and a second pair of opposing connecting walls 806*a*, 806*b*. According to one example, the first pair of opposing connecting walls 804*a*, 804*b* and the second pair of opposing connecting walls 806*a*, 806*b* may be formed of a flat planar wall, a grooved longitudinal wall or a tongued longitudinal wall. Tongued longitudinal walls are adapted to interconnect with grooved longitudinal walls of identical or substantially similar blocks. Although the tongues and grooves of the walls are shown having convex and concave surfaces, respectively, this is by way of example only and other shapes such as square or rectangular may be used. Additionally, although the tongue and grooves are shown extending the entire length of the wall, this is by way of example only.

The first sidewall 802 may comprise a lower portion 808 integrally connected to an upper portion 810. The lower portion 808 may comprise a pair of opposing lower portion sidewalls 808*a* integrally connected to a pair of opposing lower end walls 808*b*. The upper portion 810 may comprise a top surface 810*a*, a pair of opposing upper portion sidewalls 810*b* and a pair of opposing upper portion end walls 810*c* integrally connected via upper portion angular walls 810*d* forming an octagonal configuration. The upper portion sidewalls 810*b*, upper portion end walls 810*c* and upper angular walls 810*d* may have a beveled or tapered surface. Although the top surface 810*a* is shown as planar, this is by way of example only.

According to one embodiment, the block 800 may include a box 824 connected to a conduit 826 embedded within the block 800. The conduit 826 may be used for protecting and routing electrical wires through blocks and may include an opening 828 on one end in which the wires are inserted. The other end of the conduit may be connected to the box 824 which may be used for placing an electrical outlet in a structure. Although a rectangular box 824 is shown, this is by way of example only and other shapes like squares, circles and triangles may be used.

Figure 9:
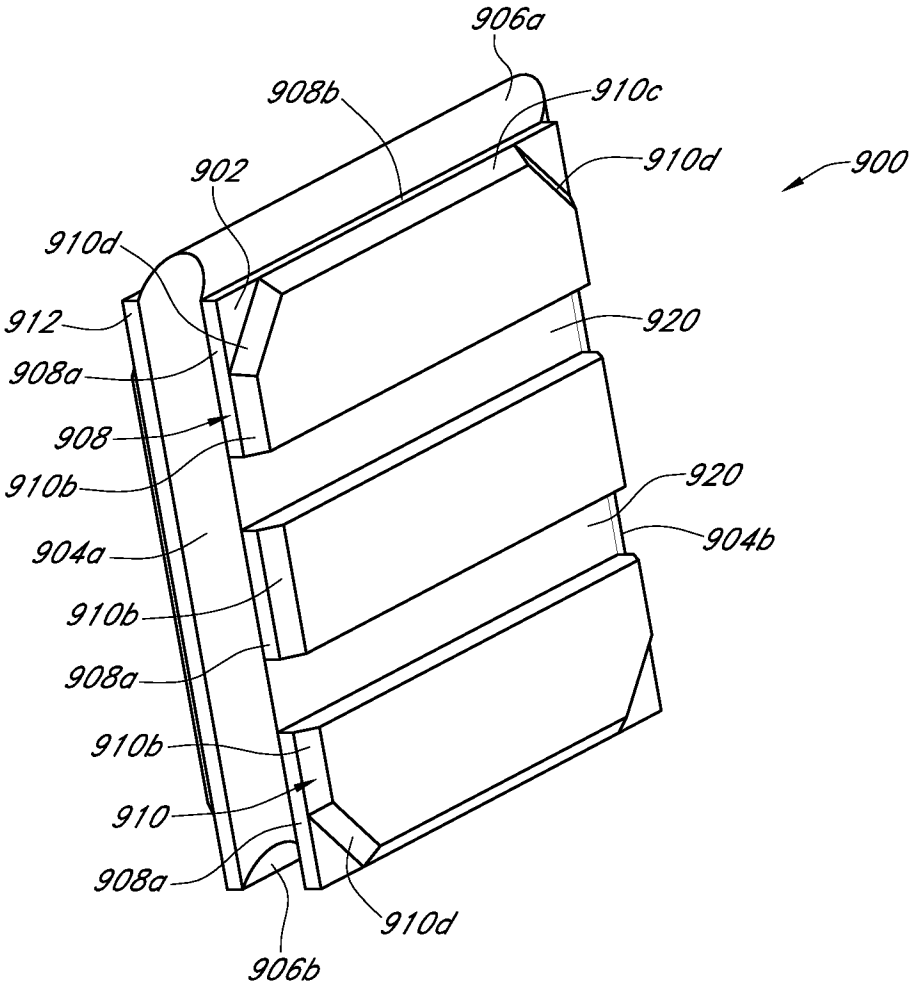
FIG. 9 illustrates an example of a tongue and groove roof tile according to one aspect.

FIG. 9 illustrates an example of a tongue and groove roof tile 900 according to one aspect. The roof tile 900 may comprise first and second opposing sidewalls 902, 912 integrally connected together by a first pair of opposing connecting walls 904*a*, 904*b* and a second pair of opposing connecting walls 906*a*, 906*b*. According to one example, the first pair of opposing connecting walls 904*a*, 904*b* and the second pair of opposing connecting walls 906*a*, 906*b* may be formed of a flat planar wall, a grooved longitudinal wall or a tongued longitudinal wall. Tongued longitudinal walls are adapted to interconnect with grooved longitudinal walls of identical or substantially similar blocks. Although the tongues and grooves of the walls are shown having convex and concave surfaces, respectively, this is by way of example only and other shapes such as square or rectangular may be used. Additionally, although the tongue and grooves are shown extending the entire length of the wall, this is by way of example only.

The first sidewall 902 may comprise a lower portion 908 integrally connected to an upper portion 910. The lower portion 908 may comprise a pair of opposing lower portion sidewalls 908*a* integrally connected to a pair of opposing lower end walls 908*b*. The upper portion 910 may comprise a top surface 910*a*, a pair of opposing upper portion sidewalls 910*b* and a pair of opposing upper portion end walls 910*c* integrally connected via upper portion angular walls 910*d* forming an octagonal configuration. The upper portion sidewalls 910*b*, upper portion end walls 910*c* and upper angular walls 910*d* may have a beveled or tapered surface.

According to one aspect, one or more channels 920 may be located within the first sidewall 902. The channels 902 may extend partially or completely through the first sidewall 902 and be adapted to interconnect with the top of a block forming a roof. The second sidewall 912 may be identical to the first sidewall 902 or may include a solid surface without the channels of the first sidewall 902.

Figure 10:
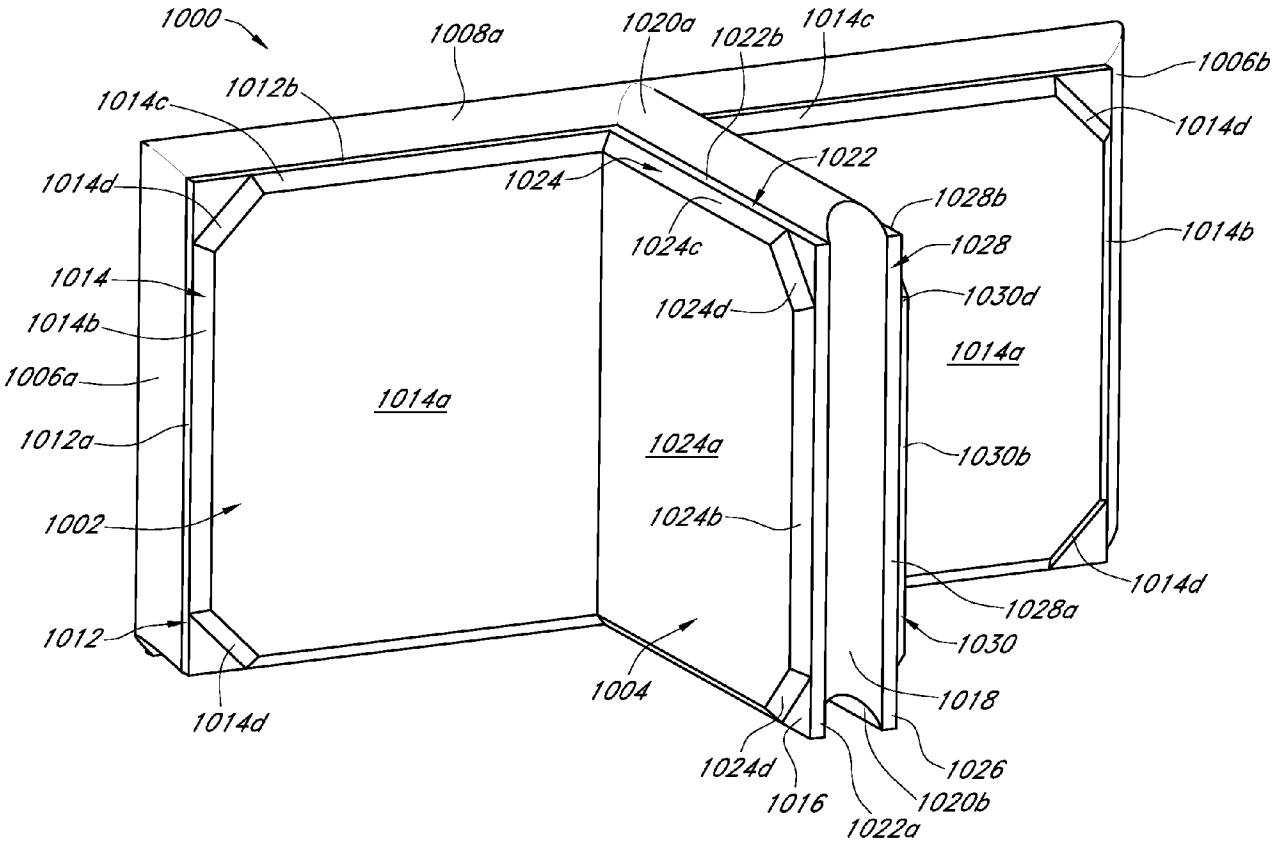
FIG. 10 illustrates an example of a "T" shaped block, according to one aspect.

FIG. 10 illustrates an example of a "T" shaped block 1000, according to one aspect. The block 1000 may comprise a base sidewall section 1002, having a front surface and a back surface, and a center section 1004 integrally connected to and extending perpendicularly from the front surface of base sidewall section 1002, approximately equidistant between a first pair of connecting walls 1006*a*, 1006*b*. The front surface and the back surface of the base sidewall section 1002 may be integrally connected together by the first pair of opposing connecting walls 1006*a*, 1006*b* and a second pair of opposing connecting walls 1008*a*, 1008*b* (1008*b* not shown). According to one example, the first pair of opposing connecting walls 1006*a*, 1006*b* and the second pair of opposing connecting walls 1008*a*, 1008*b* may be formed of a flat planar wall, a grooved longitudinal wall or a tongued longitudinal wall. Tongued longitudinal walls are adapted to interconnect with grooved longitudinal walls of identical or substantially similar blocks. Although the tongues and grooves of the walls are shown having convex and concave surfaces, respectively, this is by way of example only and other shapes such as square or rectangular may be used. Additionally, although the tongue and grooves are shown extending the entire length of the wall, this is by way of example only.

The front surface of the base sidewall section 1002 may comprise a lower portion 1012 integrally connected to an upper portion 1014. The lower portion 1012 may comprise a pair of opposing lower portion sidewalls 1012*a* integrally connected to a pair of opposing lower end walls 1012*b*. The upper portion 1014 may comprise a top surface 1014*a*, a pair of opposing upper portion sidewalls 1014*b* and a pair of opposing upper portion end walls 1014*c* integrally connected via upper portion angular walls 1014*d*. The upper portion sidewalls 1014*b*, upper portion end walls 1014*c* and upper angular walls 1014*d* may have a beveled or tapered surface.

Each of the lower end walls 1012*b* and upper end walls 1014*b* has a first section and a second section separated by the center section 1004 which may be integrally connected approximately in the middle or center of the base sidewall section 1002, equidistant from the first pair of opposing connecting walls 106*a*, 106*b*, and extend perpendicularly outward forming a "T" shape. The center section 1004 may comprise first and second opposing center sidewall portions 1016, 1026 integrally connected together by the base sidewall section 1002 at one end, a connecting end wall 1018 at the other end and a pair of opposing connecting walls 1020*a*, 1020*b*. According to one example, the connecting end wall 1018 and the pair of opposing connecting walls 1020*a*, 1020*b* may be formed of a flat planar wall, a grooved longitudinal wall or a tongued longitudinal wall. Tongued longitudinal walls are adapted to interconnect with grooved longitudinal walls of identical or substantially similar blocks. Although the tongues and grooves of the walls are shown having convex and concave surfaces, respectively, this is by way of example only and other shapes such as square or rectangular may be used. Additionally, although the tongue and grooves are shown extending the entire length of the wall, this is by way of example only.

The first center sidewall portion 1016 may comprise a lower portion 1022 integrally connected to an upper portion 1024. The lower portion 1022 may comprise a lower portion sidewall 1022*a* integrally connected to a pair of opposing lower end walls 1022*b*, the pair of opposing lower end sections 1022*b* integrally connected to the first section of the lower end walls 1012*b* of the base sidewall section 1002. The upper portion 1024 may comprise a top surface 1024*a*, an upper portion sidewall 1024*b* and a pair of opposing upper portion end walls 1024*c* integrally connected via upper portion angular walls 1024*d* and integrally connected to the first section of the upper end walls 1014*c* of the base sidewall section 1002. The upper portion sidewalls 1024*b*, upper portion end walls 1024*c* and upper angular walls 1024*d* may have a beveled or tapered surface. Although the top surface 1024*a* is shown as planar, this is by way of example only.

Although not shown in its entirety, the second center sidewall portion 1026 may be a minor image of the first center sidewall portion 1016 and comprise a lower portion 1028 integrally connected to an upper portion 1030. The lower portion 1028 may comprise a lower portion sidewall 1028*a* integrally connected to a pair of opposing lower end walls

1028*b* integrally connected to the second section of the lower end walls 1012*b* of the base sidewall section 1002. The upper portion 1030 may comprise a top surface (not shown), an upper portion sidewall 1030*b* and a pair of opposing upper portion end walls (not shown) integrally connected via upper portion angular walls 1030*d* and integrally connected to the second section of the upper portion end walls 1014*c*. The upper portion sidewalls 1030*b*, upper portion end walls 1030*c* and upper angular walls 1030*d* may have a beveled or tapered surface.

The back surface of the base sidewall section 1002 may have a lower portion and upper portion similar to the sidewalls 102, 112 as described with reference to the interconnecting construction block 100 of FIG. 1. This is by way of example only and the back surface may have other configurations.

Figure 11:
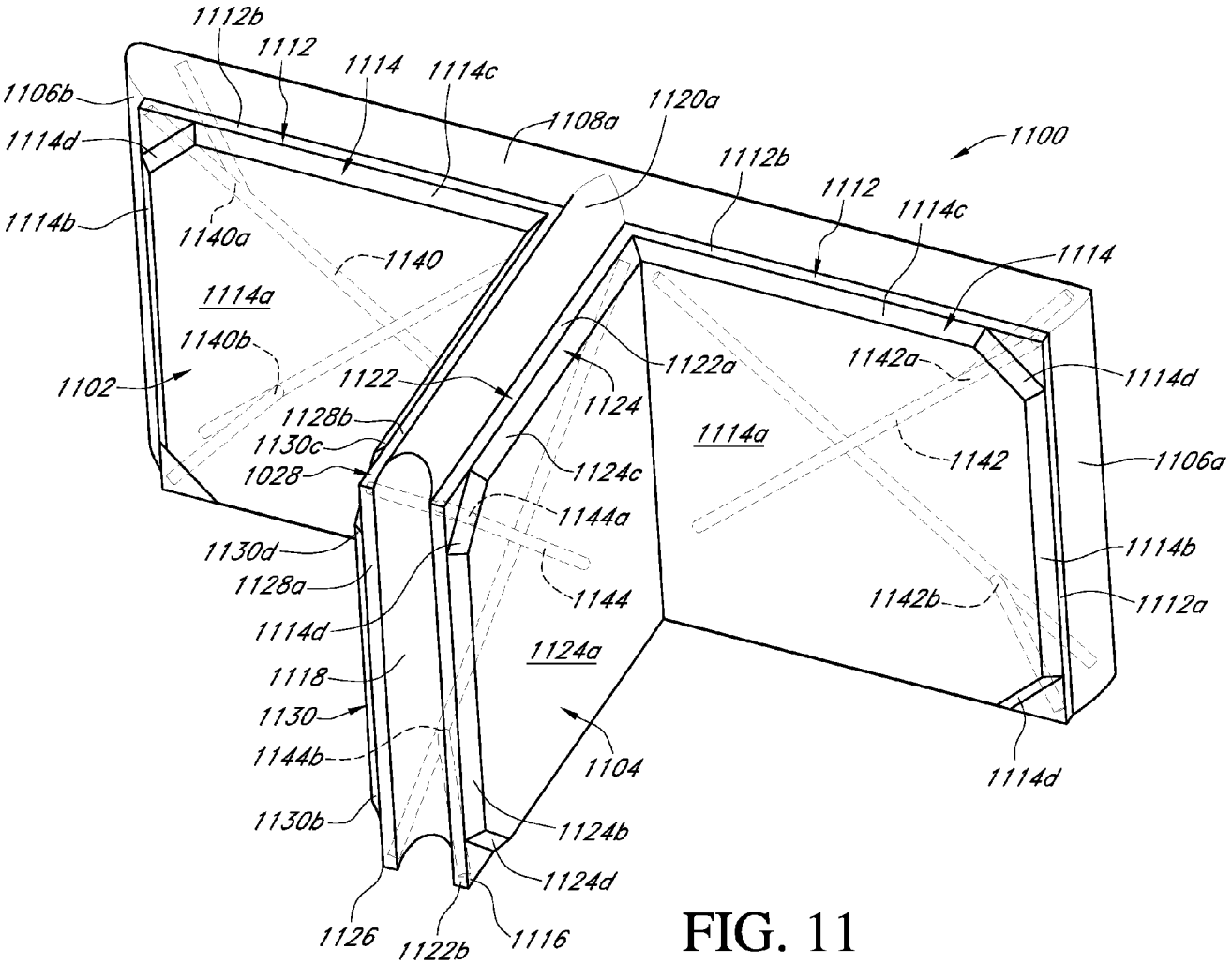
FIG. 11 illustrates an example of a "T" shaped block having reinforcement bars, according to one aspect.

FIG. 11 illustrates an example of a "T" shaped block 1100 having reinforcement bars, according to one aspect. The block 1100 may comprise a base sidewall section 1102, having a front surface and a back surface, and a center section 1104 integrally connected to and extending perpendicularly from the front surface of base sidewall section 1102, approximately equidistant between a first pair of connecting walls 1106*a*, 1106*b*. The front surface and the back surface of the base sidewall section 1102 may be integrally connected together by the first pair of opposing connecting walls 1106*a*, 1106*b* and a second pair of opposing connecting walls 1108*a*, 1108*b* (1108*b* not shown). According to one example, the first pair of opposing connecting walls 1106*a*, 1106*b* and the second pair of opposing connecting walls 1108*a*, 1108*b* may be formed of a flat planar wall, a grooved longitudinal wall or a tongued longitudinal wall. Tongued longitudinal walls are adapted to interconnect with grooved longitudinal walls of identical or substantially similar blocks. Although the tongues and grooves of the walls are shown having convex and concave surfaces, respectively, this is by way of example only and other shapes such as square or rectangular may be used. Additionally, although the tongue and grooves are shown extending the entire length of the wall, this is by way of example only.

The front surface of the base sidewall section 1102 may comprise a lower portion 1112 integrally connected to an upper portion 1114. The lower portion 1112 may comprise a pair of opposing lower portion sidewalls 1112*a* integrally connected to a pair of opposing lower end walls 1112*b*. The upper portion 1114 may comprise a top surface 1114*a*, a pair of opposing upper portion sidewalls 1114*b* and a pair of opposing upper portion end walls 1114*c* integrally connected via upper portion angular walls 1114*d*. The upper portion sidewalls 1114*b*, upper portion end walls 1114*c* and upper angular walls 1114*d* may have a beveled or tapered surface.

Each of the lower end walls 1112*b* and upper end walls 1114*b* has a first section and a second section separated by the center section 1104 which may be integrally connected approximately in the middle or center of the base sidewall section 1102, equidistant from the first pair of opposing connecting walls 1106*a*, 1106*b*, and extend perpendicularly outward forming a "T" shape. The center section 1104 may comprise first and second opposing center sidewall portions 1116, 1126 integrally connected together by the base sidewall section 1102 at one end, a connecting end wall 1118 at the other end and a pair of opposing connecting walls 1120*a*, 1120*b*. According to one example, the connecting end wall 1118 and the pair of opposing connecting walls 1120*a*, 1120*b* (1120*b* not shown) may be formed of a flat planar wall, a grooved longitudinal wall or a tongued longitudinal wall. Tongued longitudinal walls are adapted to interconnect with grooved longitudinal walls of identical or substantially similar blocks. Although the tongues and grooves of the walls are shown having convex and concave surfaces, respectively, this is by way of example only and other shapes such as square or rectangular may be used. Additionally, although the tongue and grooves are shown extending the entire length of the wall, this is by way of example only.

The first center sidewall portion 1116 may comprise a lower portion 1122 integrally connected to an upper portion 1124. The lower portion 1122 may comprise a lower portion sidewall 1122*a* integrally connected to a pair of opposing lower end walls 1122*b*, the pair of opposing lower end sections 1022*b* integrally connected to the first section of the lower end walls 1112*b* of the base sidewall section 1102. The upper portion 1124 may comprise a top surface 1124*a*, an upper portion sidewall 1124*b* and a pair of opposing upper portion end walls 1124*c* integrally connected via upper portion angular walls 1124*d* and integrally connected to the first section of the upper end walls 1114*c* of the base sidewall section 1102. The upper portion sidewalls 1124*b*, upper portion end walls 1124*c* and upper angular walls 1124*d* may have a beveled or tapered surface.

Although not shown in its entirety, the second center sidewall portion 1126 may be a mirror image of the first center sidewall portion 1116 and comprise a lower portion 1128 integrally connected to an upper portion 1130. The lower portion 1128 may comprise a lower portion sidewall 1128*a* integrally connected to a pair of opposing lower end walls 1128*b* integrally connected to the second section of the lower end walls 1112*b* of the base sidewall section 1102. The upper portion 1130 may comprise a top surface (not shown), an upper portion sidewall 1130*b* and a pair of opposing upper portion end walls (not shown) integrally connected via upper portion angular walls 1130*d* and integrally connected to the second section of the upper portion end walls 1114*c*. The upper portion sidewalls 1130*b*, upper portion end walls 1130*c* and upper angular walls 1130*d* may have a beveled or tapered surface.

According to one embodiment, pairs of reinforcement bars 1140, 1142 and 1144 may be embedded within each section of the base sidewall section 1102 as well as the center section 1104 of the block 1100, respectively. As shown, each of the reinforcement bars 1140, 1142 and 1144 may be arranged diagonally in an "X" pattern extending from one corner to the catty-corner. Each of the reinforcement bars 1140, 1142 and 1144 may extend the entire diagonal length or a partial diagonal length.

In one embodiment, a first end of each reinforcement bar in the pairs of reinforcement bars 1140, 1142 and 1144 may terminate at or near the intersection of the base sidewall section 1102 and the center section 1104 and a second end 1140*a*, 1140*b*, 1142*a*, 1142*b*, 1144*a*, 1144*b* of each reinforcement bar of the pairs of reinforcement bars 1140, 1142 and 1144 may have a generally "Y" configuration. That is, each of the second ends of the reinforcement bars 1140*a*, 1140*b*, 1142*a*, 1142*b*, 1144*a*, 1144*b* of the pairs of reinforcement bars 1140, 1142 and 1144 may split off forming a "Y".

A first leg of the "Y" end 1140*a* may extend to a first corner of the front surface of the first section of the base sidewall section 1102 and a second leg of the "Y" end 1140*a* may extend to a first corner of the back surface of the first section of the base sidewall section 1102. The first and second legs of the "Y" end 1140*a* may protrude through the first corners of the front and back surfaces of the base sidewall section 1102 allowing the block 1100, via the reinforcement bars 1140, to be bolted or welded to corners plates, as discussed below in more detail.

A first leg of the "Y" end 1140*b* may extend to a second corner of the front surface of the first section of the base sidewall section 1102 and a second leg of the "Y" end 1140*b* may extend to a second corner of the back surface of the first section of the base sidewall section 1102. The first and second legs of the "Y" end 1140*b* may protrude through the second corners of the front and back surfaces of the base sidewall section 1102 allowing the block 1100, via the reinforcement bars 1140, to be bolted or welded to corners plates, as discussed below in more detail.

A first leg of the "Y" end 1142*a* may extend to a first corner of the front surface of the second section of the base sidewall section 1102 and a second leg of the "Y" end 1142*a* may extend to a first corner of the back surface of the second section of the base sidewall section 1102. The first and second legs of the "Y" end 1142*a* may protrude through the second corners of the front and back surfaces of the base sidewall section 1102 allowing the block 1100, via the reinforcement bars 1142, to be bolted or welded to corners plates, as discussed below in more detail.

A first leg of the "Y" end 1142*b* may extend to a second corner of the front surface of the second section of the base sidewall section 1102 and a second leg of the "Y" end 1142*b* may extend to a second corner of the back surface of the second section of the base sidewall section 1102. The first and second legs of the "Y" end 1142*b* may protrude through the second corners of the front and back surfaces of the base sidewall section 1102 allowing the block 1100, via the reinforcement bars 1142, to be bolted or welded to corners plates, as discussed below in more detail.

A first leg of the "Y" end 1144*a* may extend to a first corner of the first opposing center sidewall portions 1116 of the center section 1104 and a second leg of the "Y" end 1142*a* may extend through the first corner of the second opposing center sidewall portion 1126 of the center section 1104. The first and second legs of the "Y" end 1144*a* may protrude through the first corners of the first and second opposing center sidewall portion 1116, 1126 of the base sidewall section 1102 allowing the block 1100, via the reinforcement bars 1142, to be bolted or welded to corners plates, as discussed below in more detail.

A first leg of the "Y" end 1144*b* may extend to a second corner of the first opposing center sidewall portions 1116 of the center section 1104 and a second leg of the "Y" end 1142*b* may extend to a second corner of the second opposing center sidewall portion 1126 of the center section 1104. The first and second legs of the "Y" end 1144*b* may protrude through the second corners of the first and second opposing center sidewall portion 1116, 1126 of the base sidewall section 1102 allowing the block 1100, via the reinforcement bars 1142, to be bolted or welded to corners plates, as discussed below in more detail.

The back surface of the base sidewall section 1102 may have a lower portion and upper portion similar to the sidewalls 102, 112 as described with reference to the interconnecting construction block 100 of FIG. 1. This is by way of example only and the back surface may have other configurations.

Figure 12:
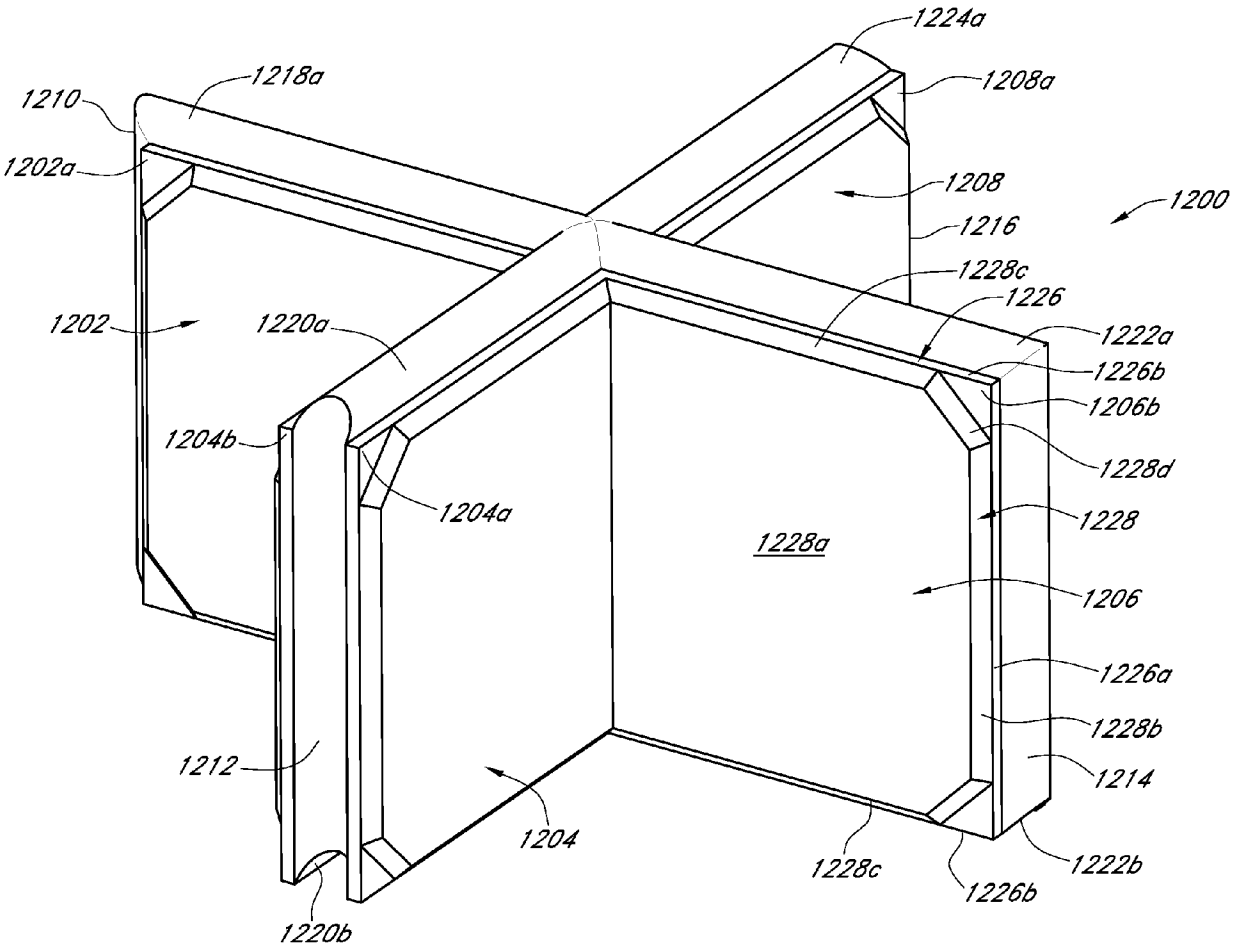
FIG. 12 illustrates an example of an "X" shaped block, according to one aspect.

FIG. 12 illustrates an example of an "X" shaped block 1200, according to one aspect. The block 1200 may be comprised of four (4) block sections 1202-1208 integrally connected at a common sidewall to form a single "X" shaped block 1200. Each of the block sections 1202-1208 may comprise a pair of sidewalls 1202*a*, 1202*b*; 1204*a*, 1204*b*; 1206*a*, 1206*b*; 1208*a*, 1208*b* integrally connected together by side connecting walls 1210-1216 and a pair of opposing end connecting walls 1218*a*, 1218*b*; 1220*a*, 1220*b*; 1222*a*, 1222*b*; 1224*a*, 1224*b* (1218*b*, 1224*b* not shown) may be formed of a flat planar wall, a grooved longitudinal wall or a tongued longitudinal wall. Tongued longitudinal walls are adapted to interconnect with grooved longitudinal walls of identical or substantially similar blocks. Although the tongues and grooves of the walls are shown having convex and concave surfaces, respectively, this is by way of example only and other shapes such as square or rectangular may be used. Additionally, although the tongue and grooves are shown extending the entire length of the wall, this is by way of example only.

Each sidewall in the pairs of sidewalls 1202*a*, 1202*b*; 1204*a*, 1204*b*; 1206*a*, 1206*b*; 1208*a*, 1208*b* has an identical configuration and therefor for the sake of brevity, only one sidewall 1206*b* of all the sidewalls forming the "X" shaped block 1200 in FIG. 12 will be described detail.

The sidewall 1206*b* may comprise a lower portion 1226 integrally connected to an upper portion 1228. The lower portion 1226 may comprise a lower portion sidewall 1226*a* integrally connected to a pair of opposing lower portion end walls 1226*b*. The upper portion 1228 may comprise a planar top surface 1228*a*, an upper portion sidewall 1228*b* and a pair of opposing upper portion end walls 1228*c* integrally connected via upper portion angular walls 1228*d*. The upper portion sidewalls 1228*b*, upper portion end walls 1228*c* and upper angular walls 1228*d* may have a beveled or tapered surface.

Figure 13:
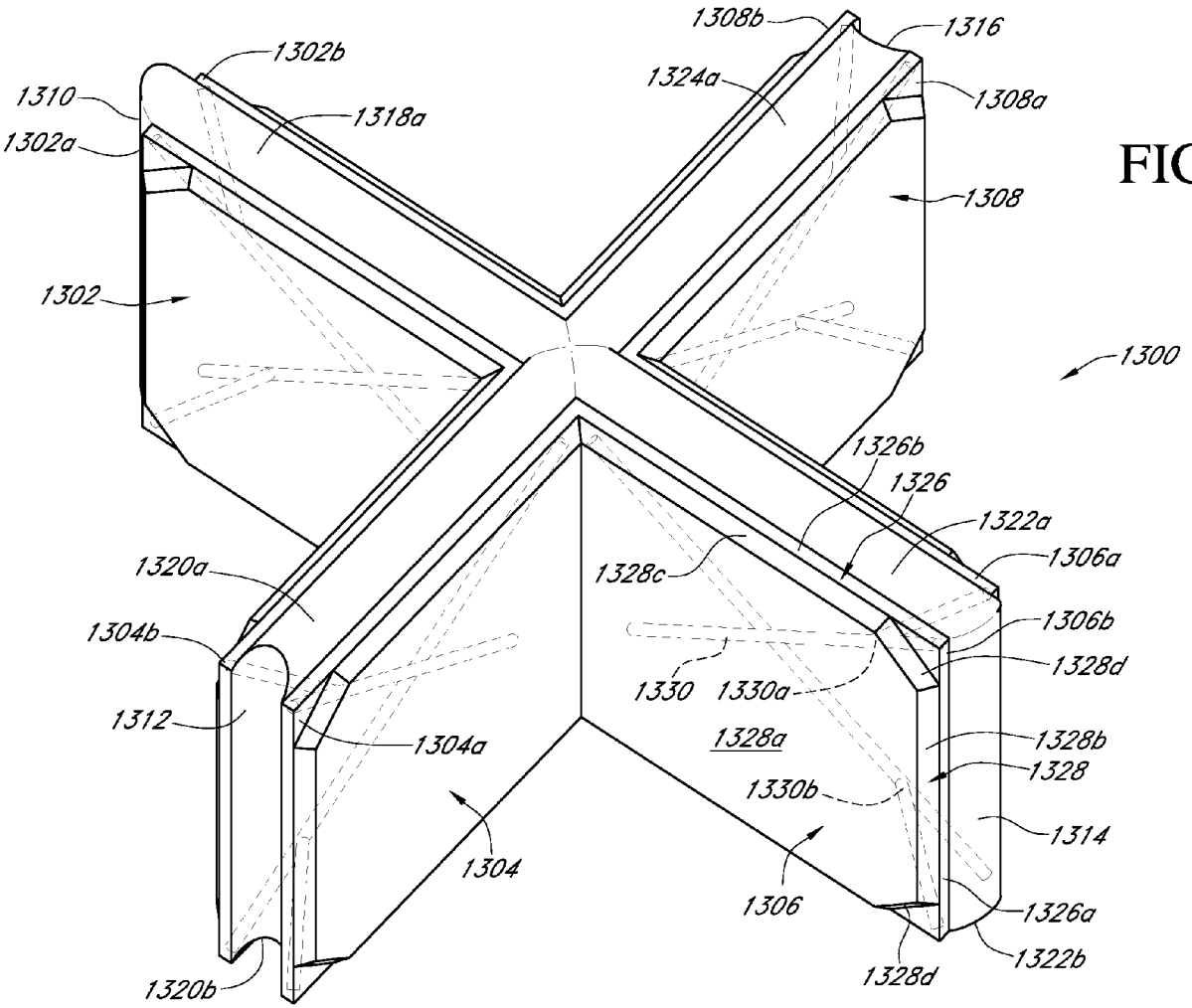
FIG. 13 illustrates an example of an "X" shaped block having reinforcement bars, according to one aspect.

FIG. 13 illustrates an example of an "X" shaped block having reinforcement bars, according to one aspect. The block 1300 may be comprised of four (4) block sections 1302-1308 integrally connected at a common sidewall to form a single "X" shaped block. Each of the block sections 1302-1308 may comprise a pair of sidewalls 1302*a*, 1302*b*; 1304*a*, 1304*b*; 1306*a*, 1306*b*; 1308*a*, 1308*b* integrally connected together by side connecting walls 1310-1316 and a pair of opposing end connecting walls 1318*a*, 1318*b*; 1320*a*, 1320*b*; 1322*a*, 1322*b*; 1324*a*, 1324*b* (1318*b*, 1324*b* not shown) may be formed of a flat planar wall, a grooved longitudinal wall or a tongued longitudinal wall. Tongued longitudinal walls are adapted to interconnect with grooved longitudinal walls of identical or substantially similar blocks. Although the tongues and grooves of the walls are shown having convex and concave surfaces, respectively, this is by way of example only and other shapes such as square or rectangular may be used. Additionally, although the tongue and grooves are shown extending the entire length of the wall, this is by way of example only.

Each sidewall in the pairs of sidewalls 1302*a*, 1302*b*; 1304*a*, 1304*b*; 1306*a*, 1306*b*; 1308*a*, 1308*b* has an identical configuration and therefor for the sake of brevity, only one sidewall 1306*b* of all the sidewalls forming the "X" shaped block 1300 in FIG. 13 will be described detail.

The sidewall 1306*b* may comprise a lower portion 1326 integrally connected to an upper portion 1328. The lower portion 1326 may comprise a lower portion sidewall 1326*a* integrally connected to a pair of opposing lower portion end walls 1326*b*. The upper portion 1328 may comprise a planar top surface 1328*a*, an upper portion sidewall 1328*b* and a pair of opposing upper portion end walls 1328*c* integrally connected via upper portion angular walls 1328*d*. The upper portion sidewalls 1328*b*, upper portion end walls 1328*c* and upper angular walls 1328*d* may have a beveled or tapered surface.

According to one embodiment, a pair of reinforcement bars may be embedded within each block sections 1302-1308 of the block 1300. For the sake of brevity, only one pair of the reinforcement bars will be described in detail. Each of the reinforcement bars 1330 may be arranged diagonally in an "X" pattern extending from one corner to the catty-corner. Each of the reinforcement bars 1330 may extend the entire diagonal length or a partial diagonal length.

In one embodiment, a first end 1330*a* of each reinforcement bar in the pair of reinforcement bars 1330 may terminate at or near the intersection of the block sections 1302-1308 and a second end 1330*b* of each reinforcement bar may have a generally "Y" configuration. That is, each of the second ends of the pair of reinforcement bars 1330 may split off forming a "Y".

A first leg of the "Y" end 1330*a* may extend to a first corner of sidewall 1302*a* and a second leg of the "Y" end 1330*a* may extend to a first corner of sidewall 1302*b*. The first and second legs of the "Y" end 1330*a* may protrude through the first corners of sidewalls 1302*a*, 1302*b* allowing the block 1300, via the reinforcement bars 1330, to be bolted or welded to corners plates, as discussed below in more detail.

Figure 14:
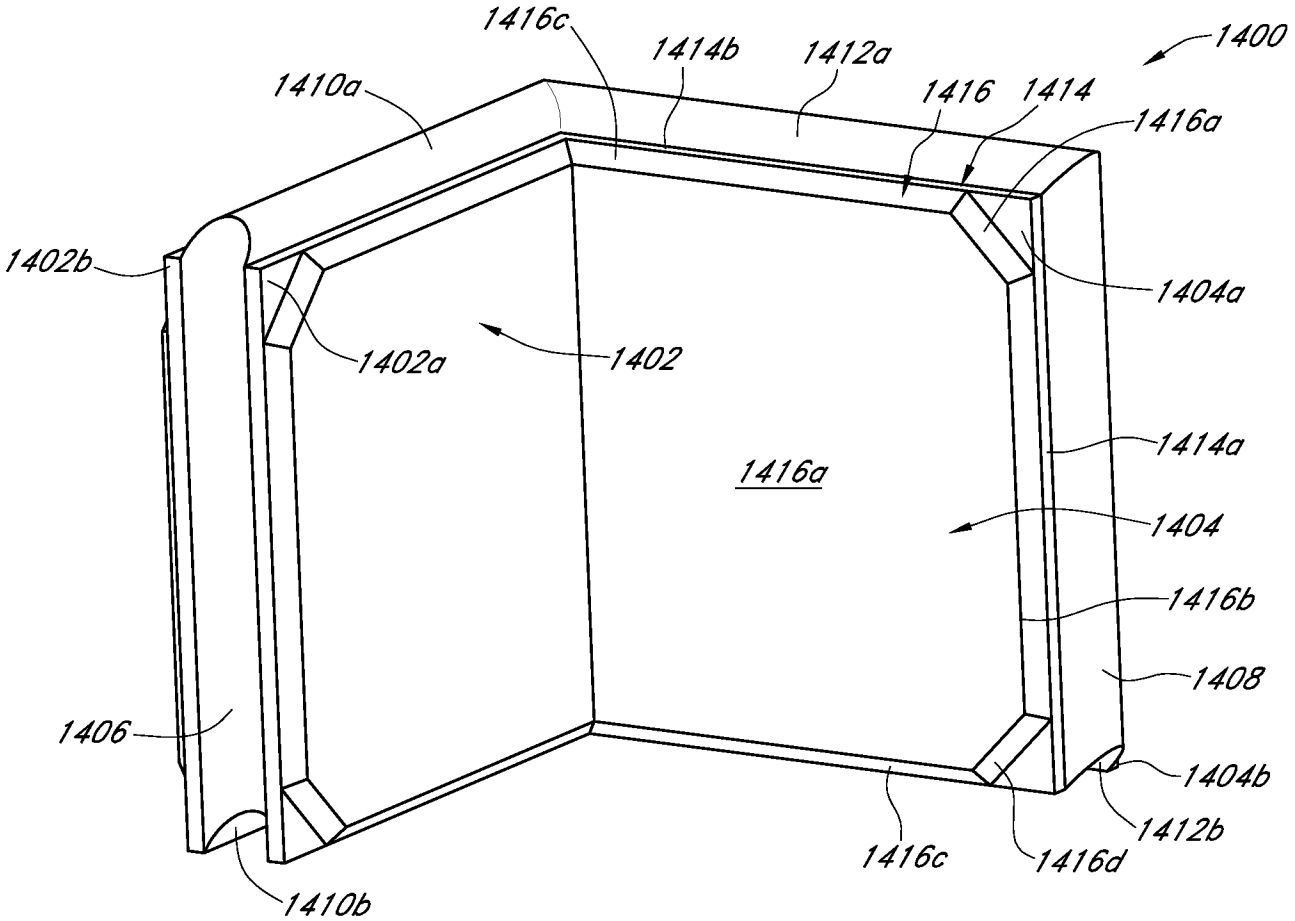
FIG. 14 illustrates a side perspective view of a corner interlocking construction block, according to one aspect.

FIG. 14 illustrates a side perspective view of a corner interlocking construction block 1400 according to one aspect. The block 1400 may be comprised of two (2) block sections 1402, 1404 integrally connected at a common sidewall to form a single corner block. Each of the block sections 1402, 1404 may comprise a pair of sidewalls 1402*a*, 1402*b* and 1404*a*, 1404*b* integrally connected together by a side connecting wall 1406, 1408 and a pair of opposing end connecting walls 1410*a*, 1410*b* and 1412*a*, 1412*b* and may be formed of a flat planar wall, a grooved longitudinal wall or a tongued longitudinal wall. Tongued longitudinal walls are adapted to interconnect with grooved longitudinal walls of identical or substantially similar blocks. Although the tongues and grooves of the walls are shown having convex and concave surfaces, respectively, this is by way of example only and other shapes such as square or rectangular may be used. Additionally, although the tongue and grooves are shown extending the entire length of the wall, this is by way of example only.

Each sidewall of the pair of sidewalls 1402*a*, 1402*b* and 1404*a*, 1404*b* has an identical configuration and therefor for the sake of brevity, only one sidewall 1404*b* of all the sidewalls forming the corner block 1400 in FIG. 14 will be described detail.

The sidewall 1404*b* may comprise a lower portion 1414 integrally connected to an upper portion 1416. The lower portion 1414 may comprise a lower portion sidewall 1414*a* integrally connected to a pair of opposing lower end walls 1414*b*. The upper portion 1416 may comprise a top surface 1416*a*, an upper portion sidewall 1416*b* and a pair of opposing upper portion end walls 1416*c* integrally connected via upper portion angular walls 1416*d*. The upper portion sidewalls 1416*b*, upper portion end walls 1416*c* and upper angular walls 1416*d* may have a beveled or tapered surface.

Figure 15:
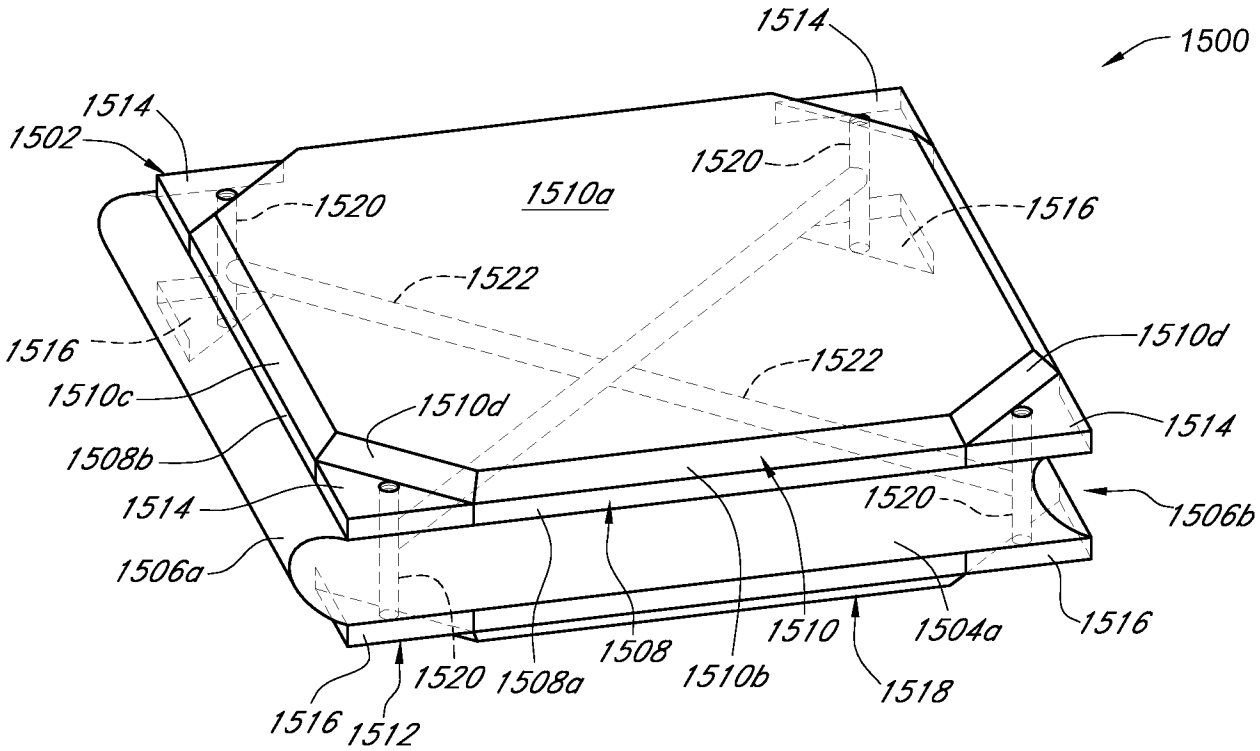
FIG. 15 illustrates a side perspective view of an interlocking construction block having corner plate covers, according to one aspect.

FIG. 15 illustrates a side perspective view of an interlocking construction block 1500 having corner plate covers, according to one aspect. The block 1500 may comprise first and second opposing sidewalls 1502, 1512 (partially shown) integrally connected together by a first pair of opposing connecting walls 1504*a*, 1504*b* (not shown) and a second pair of opposing connecting walls 1506*a*, 1506*b*. According to one example, the first pair of opposing connecting walls 1504*a*, 1504*b* and the second pair of opposing connecting walls 1506*a*, 1506*b* may be formed of a flat planar wall, a grooved longitudinal wall or a tongued longitudinal wall. Tongued longitudinal walls are adapted to interconnect with grooved longitudinal walls of identical or substantially similar blocks. Although the tongues and grooves of the walls are shown having convex and concave surfaces, respectively, this is by way of example only and other shapes such as square or rectangular may be used. Additionally, although the tongue and grooves are shown extending the entire length of the wall, this is by way of example only.

The first sidewall 1502 may comprise a lower portion 1508 integrally connected to an upper portion 1510. The lower portion 1508 may comprise a pair of opposing lower portion sidewalls 1508*a* integrally connected to a pair of opposing lower portion end walls 1508*b*. The upper portion 1510 may comprise a top surface 1510*a*, a pair of opposing upper portion sidewalls 1510*b* and a pair of opposing upper portion end walls 1510*c* integrally connected via upper portion angular walls 1510*d* forming an octagonal configuration. The upper portion sidewalls 1510*b*, upper portion end walls 1510*c* and upper angular walls 1510*d* may have a beveled or tapered surface.

The second sidewall 1512, only partially shown, has an identical configuration to the first sidewall 1502 and therefor, for the sake of brevity, will not be described herein. Corner plates 1514, 1516 may be secured to the corners of the lower upper portion 1508 of the first sidewall 1502 and the corners of the lower portion 1518 of the second sidewall 1512. Threaded members 1520, such as tubes, may be integrally connected to and extend between corresponding parallel corner plates on opposing sides walls.

In one embodiment, the threaded member 1520 may be placed in the center of each corner brace 1512, 1516 so that threaded members 1520 do not protrude through the connecting walls of the block 1500. Alternatively, the threaded members 1520 may be placed in any location that does not interfere or protrude through the connecting walls. The block 1500 may provide an alternative to welding as an outer plate may be used to secure adjoining blocks together as the outer plate is secured to the corner plates via insertion of screws or bolts into the threaded members 1520. (See FIG. 18)

In one embodiment, a pair of reinforcement bars 1522 may be integrally connected to and extend diagonally from a threaded tube 1520 in one corner to a threaded tube located in a catty-corner. The pair of reinforcement bars 1522 may provide added strength to the block 1500.

Figure 16A:
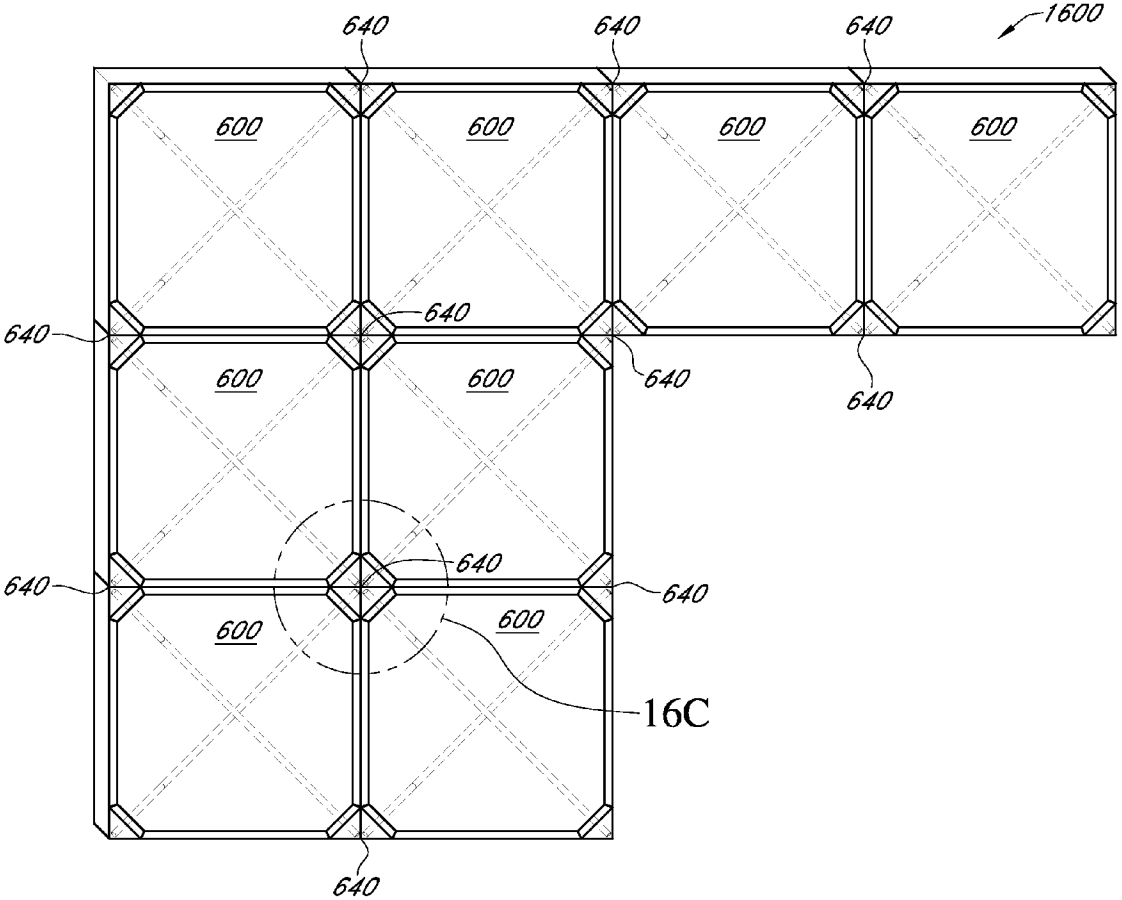
FIG. 16A illustrates an example of a partially assembled structure formed using interconnecting construction blocks having reinforcement bars as described in FIG. 6.

FIG. 16A illustrates an example of a partially assembled structure 1600 formed using interconnecting construction blocks having reinforcement bars as described in FIG. 6. As shown, a plurality of interconnecting construction blocks 600 having reinforcement bars 622 (see FIG. 6) may be interconnected to form the structure 1600, such as a wall. The "Y" shaped ends of each reinforcement bar may protrude through corners of the sidewalls 602 and 604 of each interconnected block 600 coming to a common point 640. The legs of the "Y" shaped end terminating at the common point 640 may be bolted or welded together securing the blocks together. To further secure the blocks together, grout or mortar may be place within or between adjoining beveled walls of adjoining blocks.

Figure 16C:
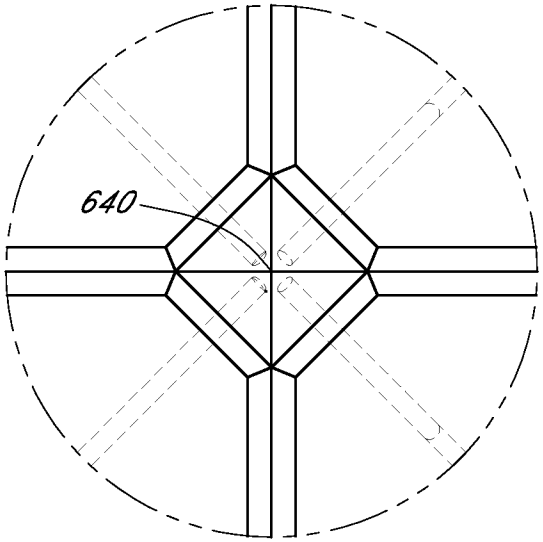
FIG. 16C illustrates a blown up view of the common point of FIG. 16A.
Figure 16B:
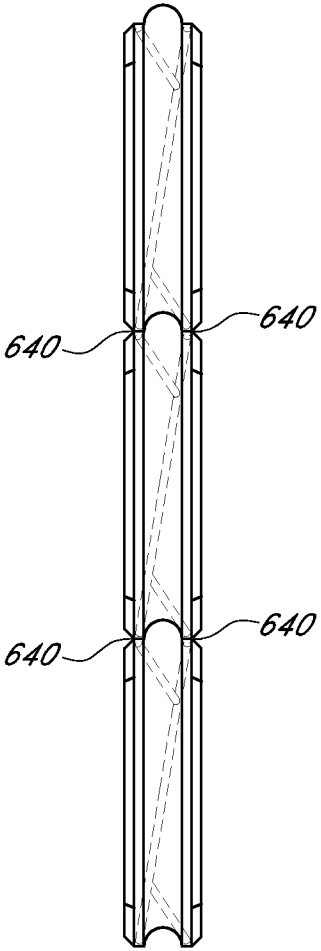
FIG. 16B illustrates a side view of the partially assembled structure of FIG. 16A using interconnecting construction blocks having reinforcement bars as described in FIG. 6.

FIG. 16B illustrates a side view of the partially assembled structure 1600 of FIG. 16A using interconnecting construction blocks having reinforcement bars as described in FIG. 6. FIG. 16C illustrates a blown up view of the common point 640 of FIG. 16A.

Figure 17A:
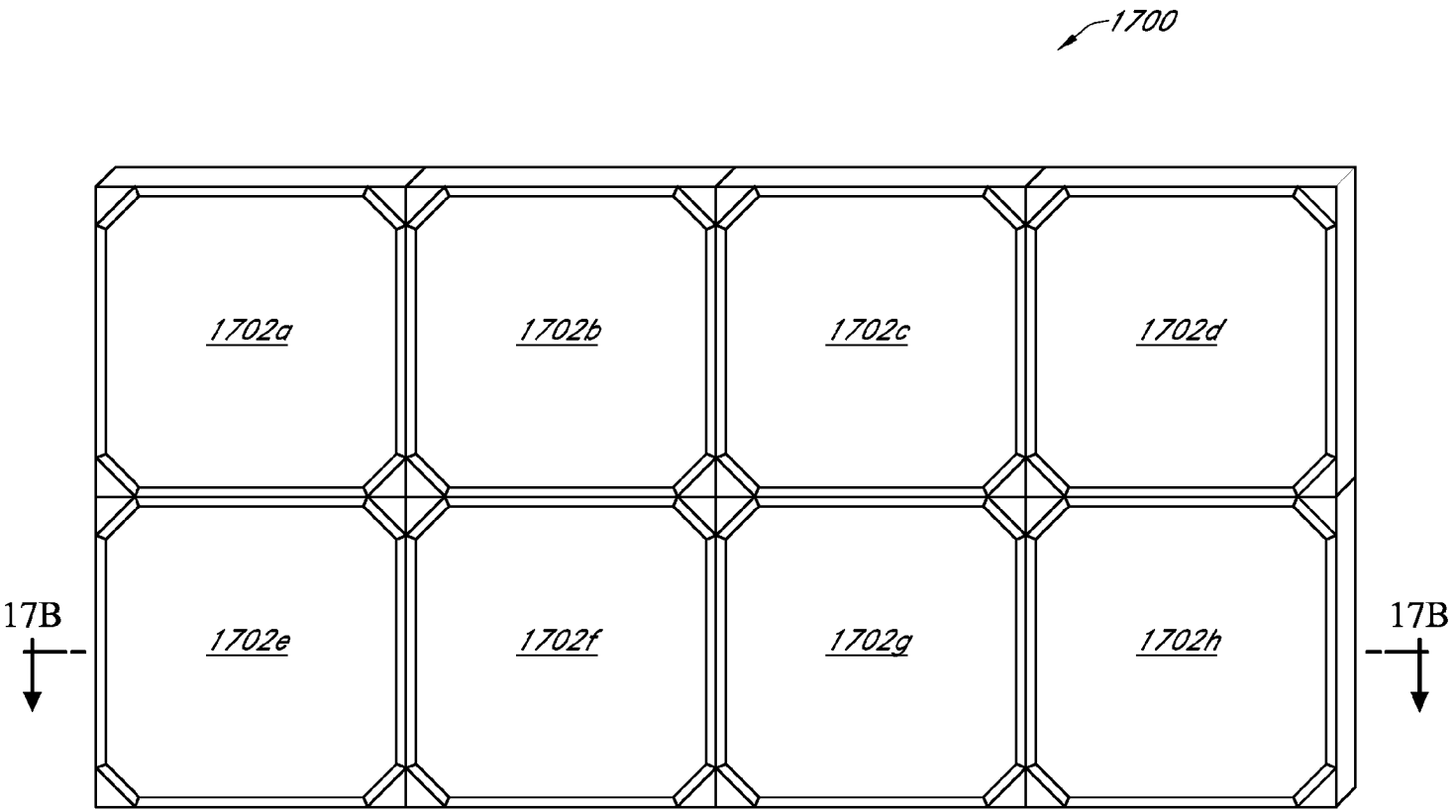
FIG. 17A illustrates an example of an assembled structure formed using a plurality of interconnecting construction blocks, according to one aspect.
Figure 17B:
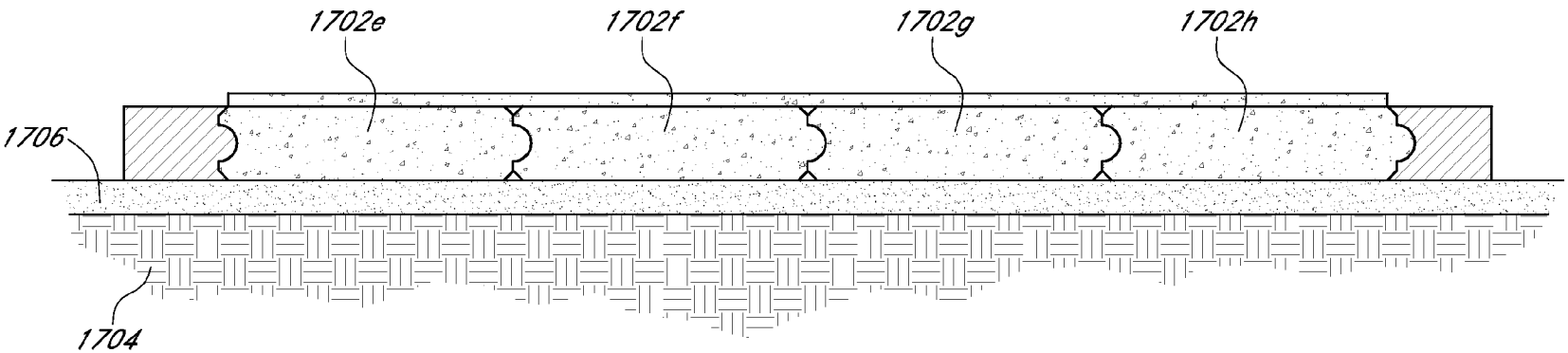
FIG. 17B illustrates a cross-sectional view of the assembled structure taken along line 17-17 of FIG. 17A.

FIG. 17A illustrates an example of an assembled structure 1700 formed using a plurality of interconnecting construction blocks 1702*a*-1702*h*. The assembled structure 1700 may be a floor. FIG. 17B illustrates a cross-sectional view of the assembled structure taken along line 17-17 of FIG. 17A. As shown in FIG. 17B, when the floor 1700, using the interconnecting constructions blocks disclosed herein, may be constructed on a sand bedding 1706 on top of compacted soil 1704. Concrete may then be placed on top of the assembled structure.

Figure 18:
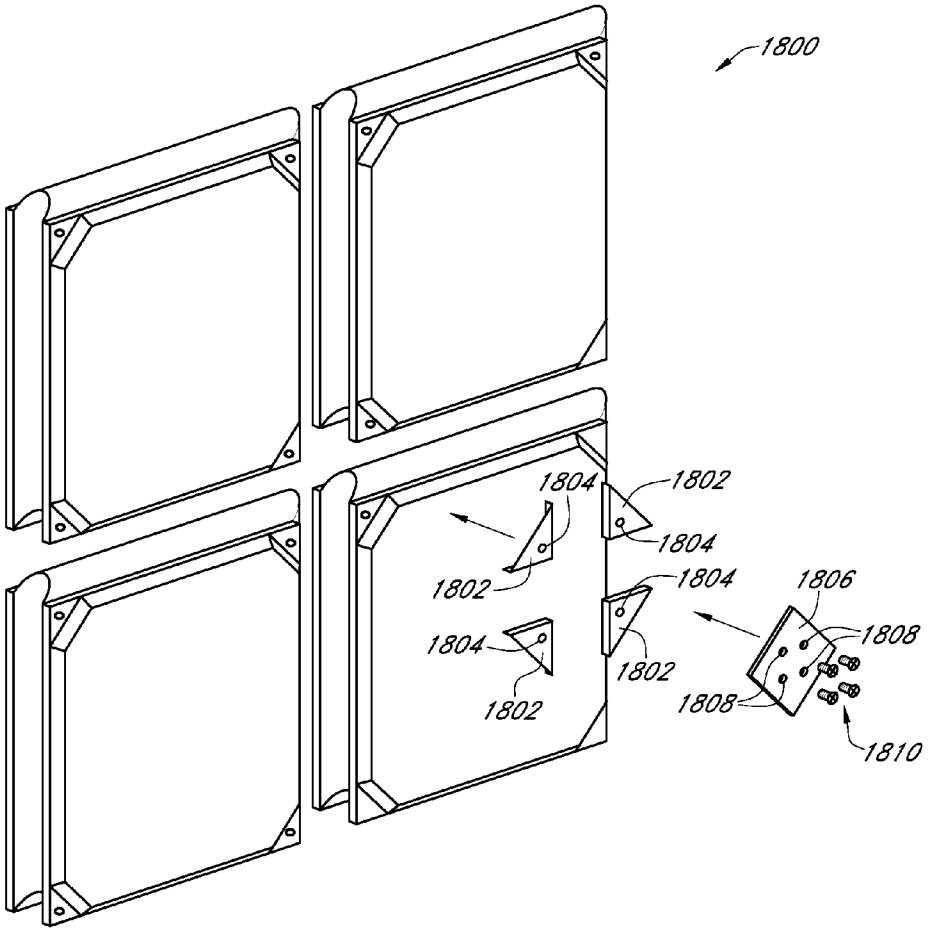
FIG. 18 illustrates an exploded view of a structure constructed with the interconnecting construction blocks of FIG. 15 or FIG. 19.
Figure 19:
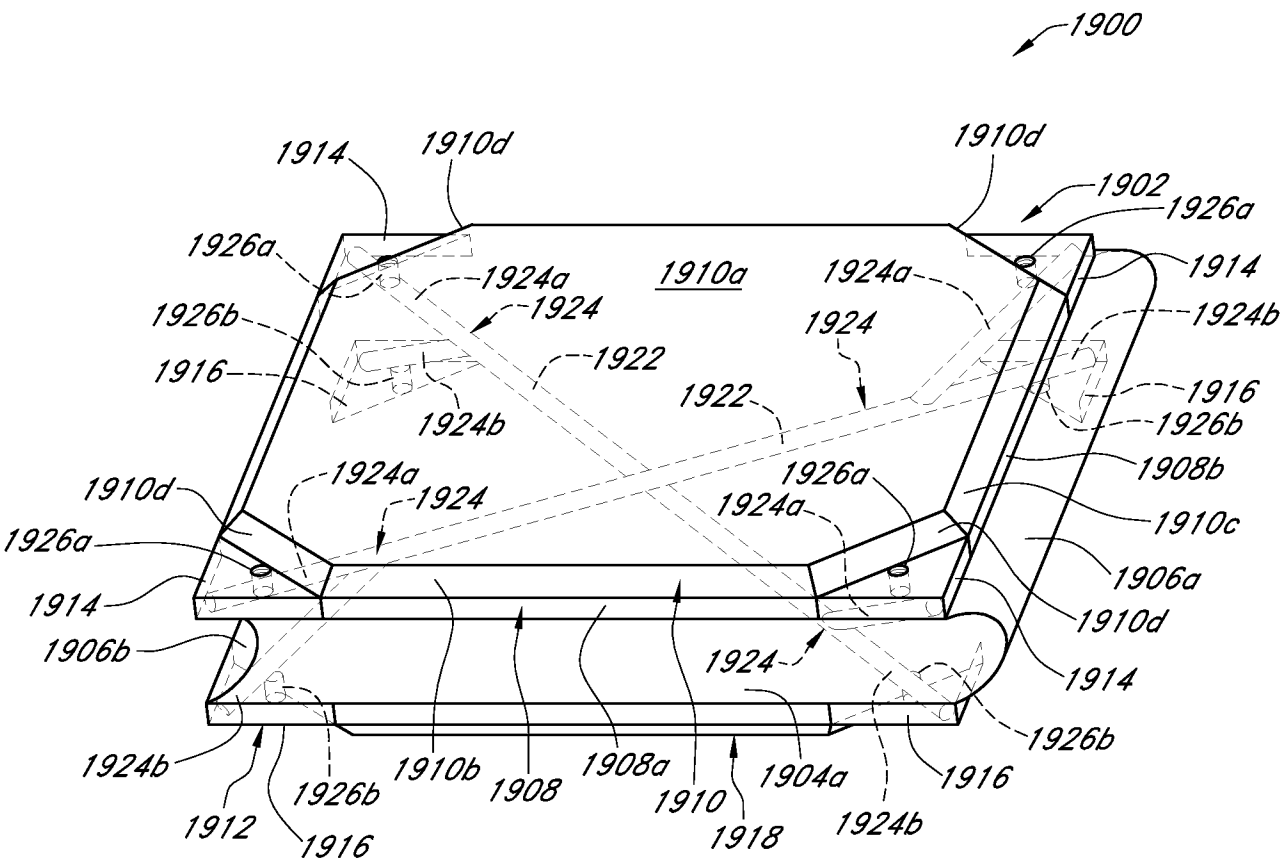
FIG. 19 illustrates a side perspective view of an interlocking construction block having corner plate covers, according to one aspect.

FIG. 18 illustrates an exploded view of a structure 1800 constructed with the interconnecting construction blocks of FIG. 15 or FIG. 19. As shown, four (4) interconnecting construction blocks 1500 may be assembled together to form the structure. As discussed above, corner plates 1802 may be secured to the corners of the first and second sidewalls. The corner plates 1802 may include an opening or a hole 1804 in alignment with the threaded members 1520, extending between opposing parallel corner plates in the blocks 1500, and adapted to receive securing members 1810, such as a screw or bolt.

Upon the interconnection of one or more blocks, an outer plate 1806 having threaded openings 1808 may be placed over adjoining corner plates such that the threaded holes 1804 of the corner plates may be aligned with the threaded holes 1808 of the outer plate 1806. Once the outer plate 1806 is aligned with and placed on the corner plates 1802, securing members 1810, such as screws, may be inserted into the threaded holes 1808 of the outer plate 1806, though the threaded holes 1804 of the corner plates 1802 and screwed into the threaded member securing the interconnecting construction blocks together, as discussed above with reference to FIG. 15. To further secure the blocks together, grout or mortar may be place within or between adjoining beveled walls of adjoining blocks.

FIG. 19 illustrates a side perspective view of an interlocking construction block 1900 having corner plate covers, according to one aspect. The block 1900 may comprise first and second opposing sidewalls 1902, 1912 (partially shown) integrally connected together by a first pair of opposing connecting walls 1904*a*, 1904*b* (not shown) and a second pair of opposing connecting walls 1906*a*, 1906*b*. According to one example, the first pair of opposing connecting walls 1904*a*, 1904*b* and the second pair of opposing connecting walls 1906*a*, 1906*b* may be formed of a flat planar wall, a grooved longitudinal wall or a tongued longitudinal wall. Tongued longitudinal walls are adapted to interconnect with grooved longitudinal walls of identical or substantially similar blocks. Although the tongues and grooves of the walls are shown having convex and concave surfaces, respectively, this is by way of example only and other shapes such as square or rectangular may be used. Additionally, although the tongue and grooves are shown extending the entire length of the wall, this is by way of example only.

The first sidewall 1902 may comprise a lower portion 1908 integrally connected to an upper portion 1910. The lower portion 1908 may comprise a pair of opposing lower portion sidewalls 1908*a* integrally connected to a pair of opposing lower end walls 1908*b*. The upper portion 1910 may comprise a top surface 1910*a*, a pair of opposing upper portion sidewalls 1910*b* and a pair of opposing upper portion end walls 1910*c* integrally connected via upper portion angular walls 1910*d* forming an octagonal configuration. The upper portion sidewalls 1910*b*, upper portion end walls 1910*c* and upper angular walls 1910*d* may have a beveled or tapered surface.

The second sidewall 1912, only partially shown, has an identical configuration to the first sidewall 1902 and therefor for the sake of brevity will not be described herein. Corner braces or plates 1914, 1916 may be attached to the corners of the lower upper portion 1908 of the first sidewall 1902 and the corners of the lower upper portion 1918 of the second sidewall 1912.

According to one embodiment, a pair of reinforcement bars 1922 may be embedded within the block 1900. As shown, each of the reinforcement bars 1922 may be arranged diagonally in a "X" pattern extending from one corner to the cattycorner. Each of the reinforcement bars 1922 may extend the entire diagonal length or a partial diagonal length. The ends 1924 of each of the reinforcement bars 1922 may have a generally "Y" configuration. That is, each of the four (4) ends of the reinforcement bars 1922 may split off forming a "Y". A first leg of the "Y" end may extend to a first corner on the first sidewall 1902 and a second leg of the "Y" may extend to a second corner on the second sidewall 1912, opposite the first corner. The first and second legs of the "Y" end may protrude through corners of the sidewalls 1902 and 1912 allowing the block 1900, via the reinforcement bars 1922, to be bolted, screwed or welded to outer plates, as discussed above.

Figure 20:
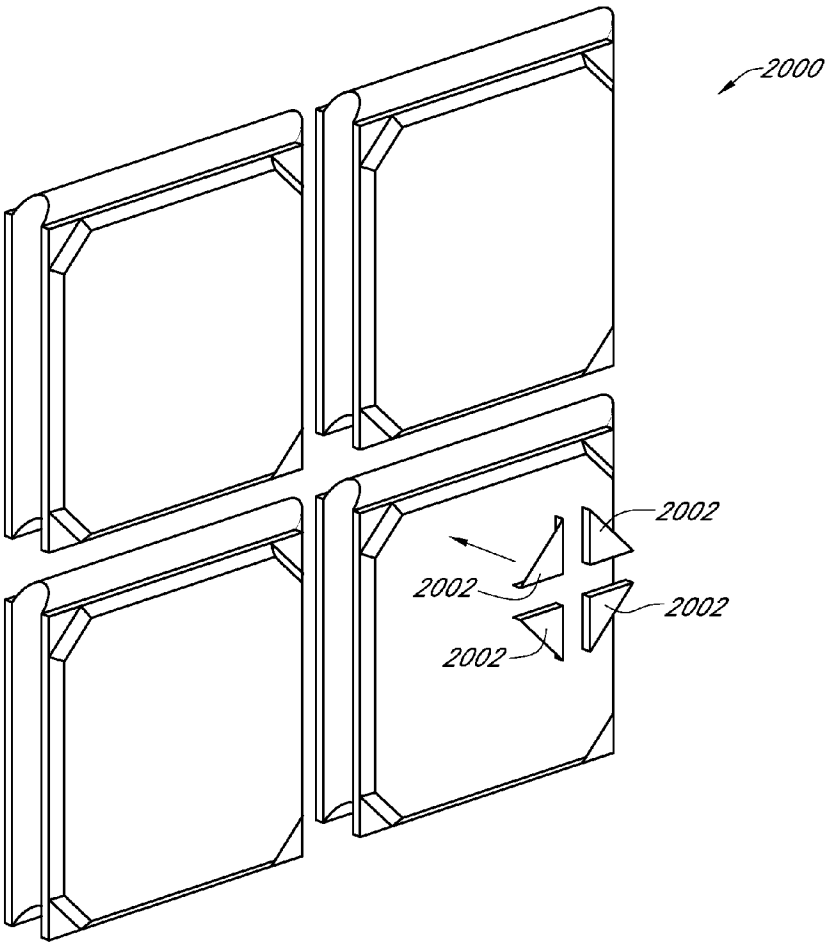
FIG. 20 illustrates an exploded view of a structure constructed with interconnecting construction blocks, according to one aspect.

FIG. 20 illustrates an exploded view of a structure 2000 constructed with interconnecting construction blocks. Any of the interconnecting construction blocks disclosed herein may be used in the construction of the structure 2000. Accordingly, the interconnecting construction blocks will not be discussed in great detail for the sake of brevity.

As shown, four (4) interconnecting construction blocks may be assembled together to form the structure 2000. To further secure the interconnecting construction blocks together, corner plates 2002 may be fixedly secured to the corners of the interconnecting construction blocks. Adjacent corner plates 2002 may be welded together fixedly securing the interconnecting construction blocks together. Mortar or grout may subsequently be placed at the intersection of the interconnecting construction blocks as described above.

Figure 21:
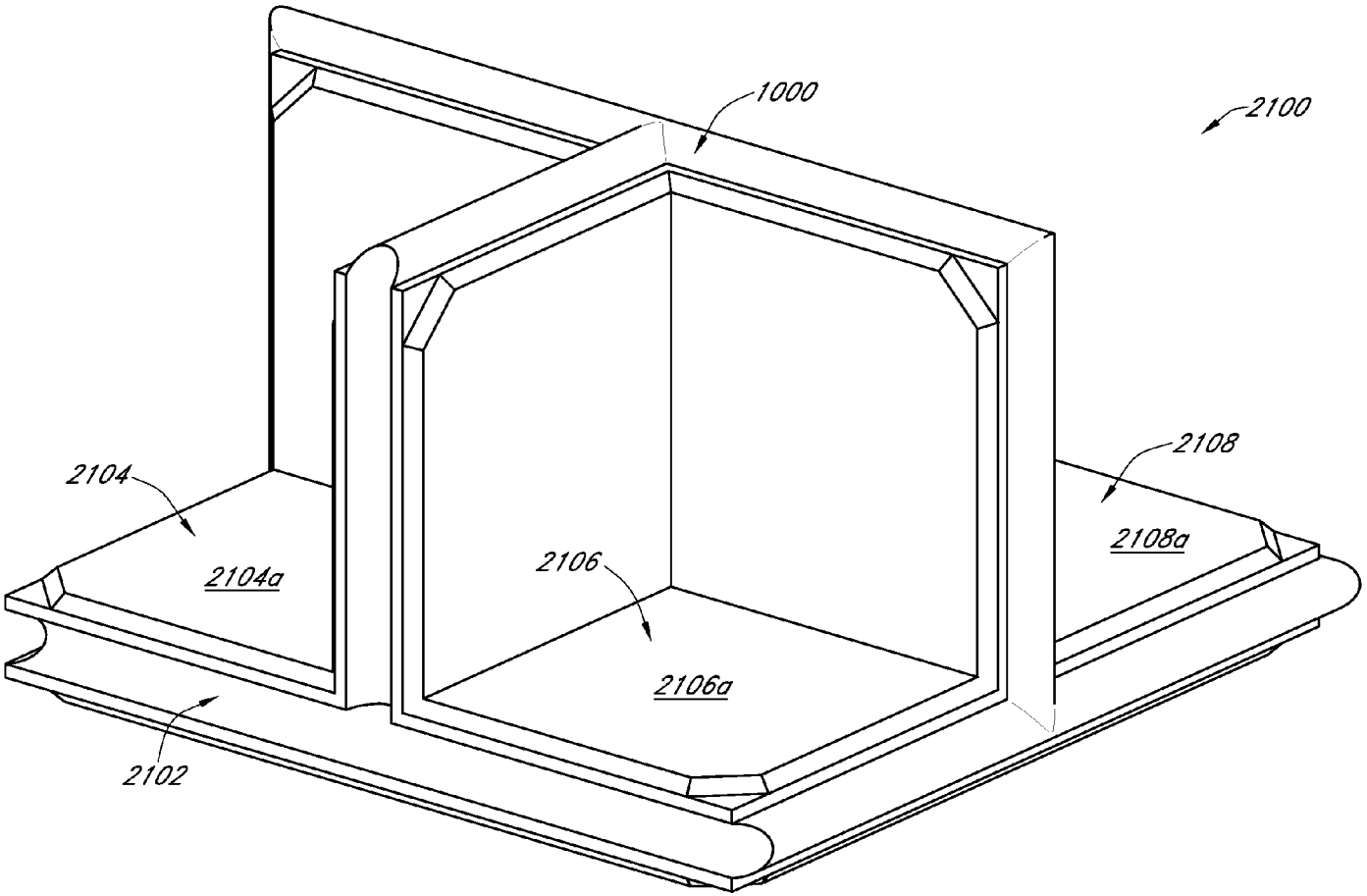
FIG. 21 illustrates a side perspective view of a bottom "T" shaped interconnecting construction block, according to one aspect.

FIG. 21 illustrates a side perspective view of a bottom "T" shaped interconnecting construction block 2100, according to one aspect. The bottom "T" shaped interconnecting construction block 2100 may be comprised of the "T" shaped block 1000 of FIG. 10 integrally connected to a base member 2102. The base member 2102 may have a back surface (not shown) and an opposing front surface. The back surface may be comprised of one continuous surface while the front surface may be comprised of three (3) block sections 2104-2108 integrally connected to the "T" shaped block 1000. First and second block sections 2104 and 2106 may be separated by the center section 1004 of the "T" shaped block 1000. The third block section 2108 may be separated from the first and second block sections 2104 and 2106 by the base sidewall section 1002. In one embodiment, the first and second block sections 2104 and 2106 may each have approximately half the surface area of the third block section 2108.

The front surface of the base member 2102 may be formed from upper sidewalls 2104*a*-2108*a* of the block sections 2104-2108. The upper sidewalls 2104*a*-2108*a* may have substantially the same configuration as the first sidewall of block 100 in FIG. 1, however, the lower and upper portions of the upper sidewalls 2104*a*-2108*a* of the block sections 2104-2108 are integrally connected to the lower and upper portions of the base sidewall section 1002 and the center section 1004 of the "T" shaped block.

Figure 22:
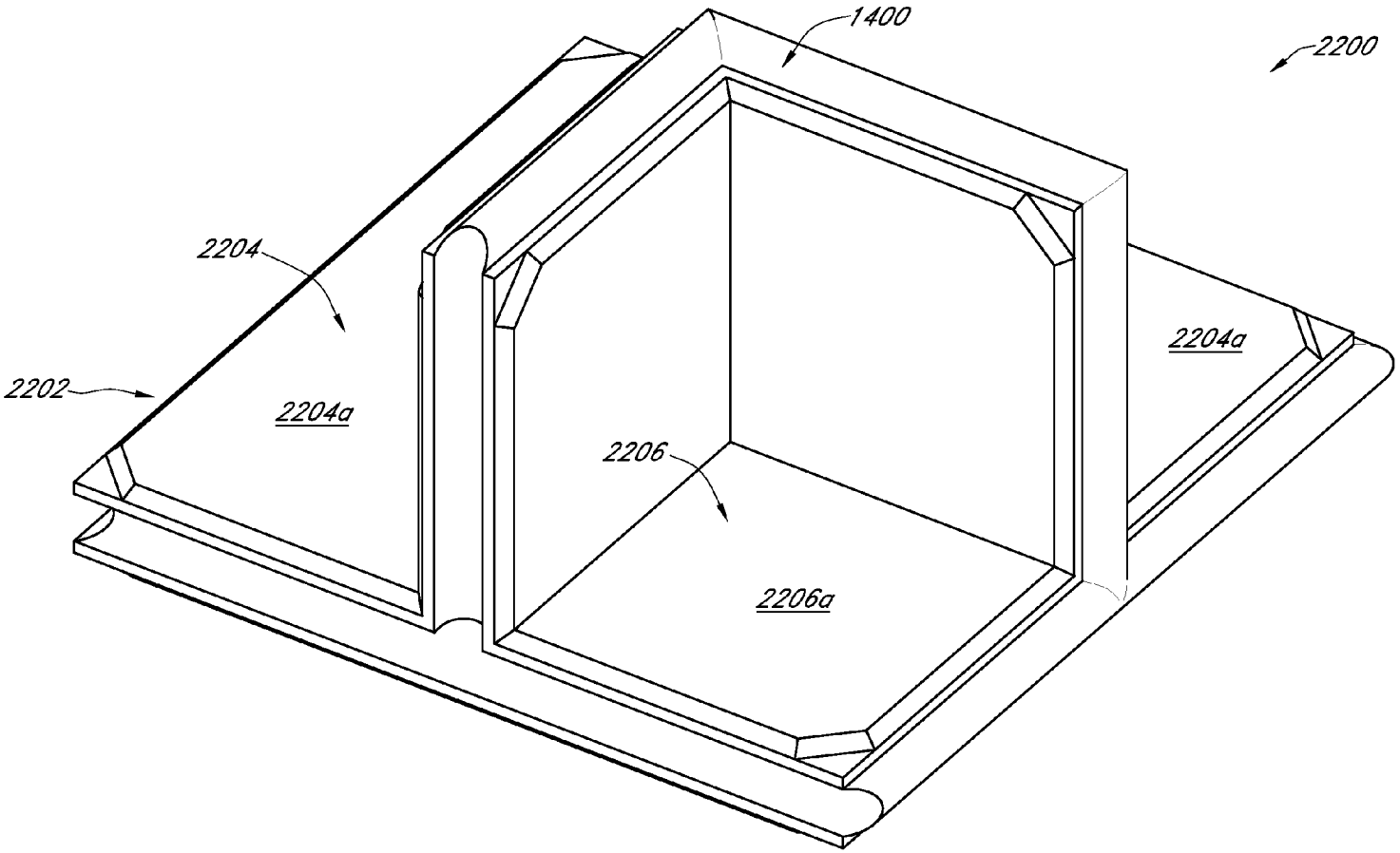
FIG. 22 illustrates a side perspective view of a bottom corner interconnecting construction block, according to one aspect.

FIG. 22 illustrates a side perspective view of a bottom corner interconnecting construction block 2200, according to one aspect. The bottom corner interconnecting construction block 2200 may be comprised of the block 1400 of FIG. 14 integrally connected to a base member 2202. The base member 2202 may have a back surface (not shown) and an opposing front surface. The back surface may be comprised of one continuous surface while the front surface may be comprised of two (2) block sections 2204, 2206 integrally connected to the "T" shaped block 1000. First and second block sections 2204 and 2206 may be separated by the block 1400. In one embodiment, the first section 2204 may have approximately half the surface area of the second block section 2206.

The front surface of the base member 2202 may be formed from upper sidewalls 2204*a*, 2206*a* of the block sections 2204, 2206. The upper sidewalls 2204*a*-2206*a* may have substantially the same configuration as the first sidewall of block 100 in FIG. 1, however, the lower and upper portions of the upper sidewalls 2204*a*-2206*a* of the block sections 2204-2206 are integrally connected to the lower and upper portions of the sidewalls 1402*a*, 1402*b* and 1404*a*, 1404*b* of FIG. 14.

Figure 23:
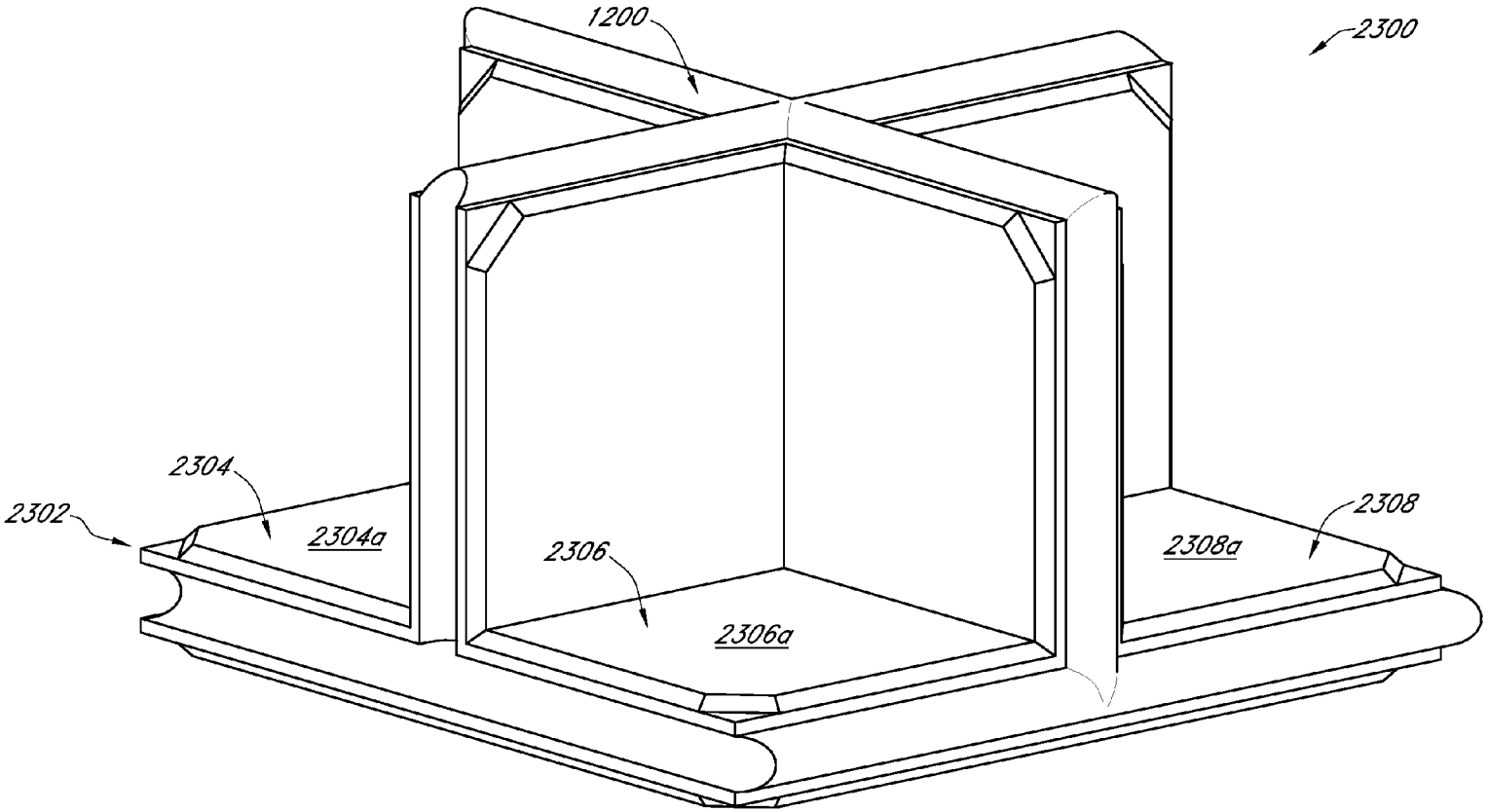
FIG. 23 illustrates a side perspective view of a bottom "X" shaped interconnecting construction block, according to one aspect

FIG. 23 illustrates a side perspective view of a bottom "X" shaped interconnecting construction block 2300, according to one aspect. The bottom "X" shaped interconnecting construction block 2300 may be comprised of the "X" shaped block 1200 of FIG. 12 integrally connected to a base member 2302. The base member 2302 may have a back surface (not shown) and an opposing front surface. The back surface may be comprised of one continuous surface while the front surface may be comprised of four (4) block sections 2304-2310 (2310 not shown) integrally connected to the "X" shaped block 1200.

First and second block sections 2304 and 2306 of the base member 2302 may be separated by a first block section 1204 of the "X" shaped block 1200. Second and third block sections 2306 and 2308 of the base member 2302 may be separated by a second block section 1206 of the "X" shaped block 1200. Third and fourth block sections 2308 and 2310 of the base member 2302 may be separated by a third block section 1208 of the "X" shaped block 1200. First and fourth block sections 2304 and 2308 of the base member 2302 may be separated by a second block section 1206 of the "X" shaped block 1200. In one embodiment, each of the block sections 2304-2310 may equal surface areas which may be approximately a quarter of the surface area of the bask surface.

The front surface of the base member 2302 may be formed from upper sidewalls 2304*a*-2310*a* of the block sections 2304-2310. The upper sidewalls 2304*a*-2310*a* may have substantially the same configuration as the first sidewall of block 100 in FIG. 1, however, the lower and upper portions of the upper sidewalls 2304*a*-2310*a* of the block sections 2304-2310 are integrally connected to the lower and upper portions of the sidewalls 1202*a*, 1202*b* and 1204*a*, 1204*b* of FIG. 12.

Figure 24:
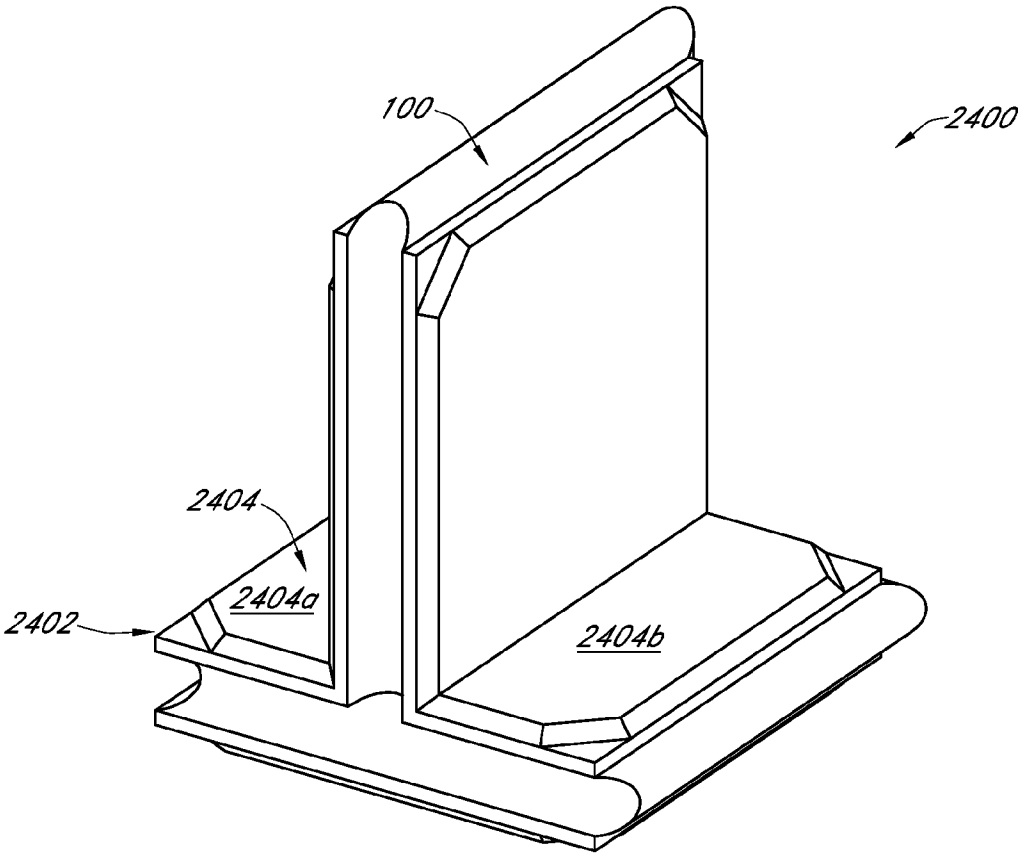
FIG. 24 illustrates a "T" shaped block, according to one aspect.

FIG. 24 illustrates a "T" shaped block 2400, according to one aspect. The block 2400 may comprise a base section 2402, having a front surface and a back surface, and a center block 100 integrally connected to and extending perpendicularly from the front surface of base section 2402. The front surface and the back surface of the base section 2402 may be integrally connected together by the first pair of opposing connecting walls and a second pair of opposing connecting walls. According to one example, the first pair of opposing connecting walls and the second pair of opposing connecting walls may be formed of a flat planar wall, a grooved longitudinal wall or a tongued longitudinal wall. Tongued longitudinal walls are adapted to interconnect with grooved longitudinal walls of identical or substantially similar blocks. Although the tongues and grooves of the walls are shown having convex and concave surfaces, respectively, this is by way of example only and other shapes such as square or rectangular may be used. Additionally, although the tongue and grooves are shown extending the entire length of the wall, this is by way of example only.

The front surface 2404 of the base section 2402 has an identical configuration to the front surface base sidewall section 1002 of FIG. 10 and therefor, for the sake of brevity, will not be described in detail herein. In one embodiment, the surface area 2404*a* of each section of the front surface is approximately half the surface area of each section of the top surface 1014*a* of the base sidewall section 1002.

One or more of the components and functions illustrated in FIGS. 1-23 may be rearranged and/or combined into a single component or embodied in several components without departing from the invention. Additional elements or components may also be added without departing from the invention.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

The invention claimed is:

1. An interlocking construction block, comprising:

a first sidewall, comprising:

a first lower portion; and a first upper portion integrally connected to the first lower portion, the first upper portion comprising:

a first plurality of walls; and a first outer side surface integrally connected to the first plurality of walls, the first plurality of walls tapering inwardly from the first lower portion to the first outer side surface;

a second sidewall integrally connected to the first sidewall by at least one upper end wall and at least one side end wall, where the at least one upper end wall and the at least one side end wall have a tongue and groove configuration;

a first reinforcement bar and a second reinforcement bar embedded within the first and second sidewalls;

a first threaded member extending from and protruding through a first corner of the first sidewall to a first corner of the second sidewall;

a second threaded member extending from and protruding through a second corner of the first sidewall to a second corner of the second sidewall;

a third threaded member extending from and protruding through a third corner of the first sidewall to a third corner of the second sidewall; and a fourth threaded member extending from and protruding through a fourth corner of the first sidewall to a fourth corner of the second sidewall; and wherein the first reinforcement bar is integrally connected to and extends between the first threaded member and the third threaded member; and wherein the second reinforcement bar is integrally connected to and extends between the second threaded member and the fourth threaded member and across the first reinforcement bar.

2. The block of claim 1, further comprising a first corner plate integrally connected to the first threaded member; and wherein an outer plate is integrally connected to the first corner plate and adjoining corner plates of adjoining matingly engaged blocks.

3. The block of claim 2, wherein the outer plate is bolted or welded to the first corner plate and adjoining corner plates.

4. The block of claim 1, wherein the first plurality of walls comprise:

a pair of upper portion sidewalls; and a pair of upper portion end walls integrally connected to the plurality of upper portion sidewalls by upper portion angular walls forming an octagonal configuration.

5. The block of claim 1, wherein the second sidewall comprises a second lower portion integrally connected to a second upper portion, the second upper portion comprising a second plurality of walls; and a second outer side surface integrally connected to the second plurality of walls, the second plurality of walls tapering inwardly from the second lower portion to the second outer side surface.

6. The block of claim 1, wherein the first reinforcement bar has a first end and a second end extending from a first corner of the block to a first catty corner; and the second reinforcement bar has a third end and a fourth end extending from a second corner of the block to a second catty corner.

7. An interlocking construction block, comprising:

a first sidewall, comprising:

a first lower portion; and a first upper portion integrally connected to the first lower portion, the first upper portion comprising:

a first plurality of walls; and a first outer side surface integrally connected to the first plurality of walls, the first plurality of walls tapering inwardly from the first lower portion to the first outer side surface;

a second sidewall integrally connected to the first sidewall by at least one upper end wall and at least one side end wall, where the at least one upper end wall and the at least one side end wall have a tongue and groove configuration, the second sidewall comprises:

a second lower portion; and a second upper portion integrally connected to the second lower portion, the second upper portion comprising:

a second plurality of walls; and a second outer side surface integrally connected to the second plurality of walls, the second plurality of walls tapering inwardly from the second lower portion to the second outer side surface;

a first reinforcement bar and a second reinforcement bar embedded within the first and second sidewalls;

a first threaded member extending from and protruding through a first corner of the first sidewall to a first corner of the second sidewall;

a second threaded member extending from and protruding through a second corner of the first sidewall to a second corner of the second sidewall;

a third threaded member extending from and protruding through a third corner of the first sidewall to a third corner of the second sidewall; and a fourth threaded member extending from and protruding through a fourth corner of the first sidewall to a fourth corner of the second sidewall; and wherein the first reinforcement bar is integrally connected to and extends between the first threaded member and the third threaded member; and wherein the second reinforcement bar is integrally connected to and extends between the second threaded member and the fourth threaded member and across the first reinforcement bar.

8. The block of claim 7, wherein the first plurality of walls comprise:

a pair of upper portion sidewalls; and a pair of upper portion end walls integrally connected to the plurality of upper portion sidewalls by upper portion angular walls forming an octagonal configuration.

9. The block of claim 7, wherein the first reinforcement bar has a first end and a second end extending from a first corner of the block to a first catty corner; and the second reinforcement bar has a third end and a fourth end extending from a second corner of the block to a second catty corner.

* * * * *